US011660863B2

(12) United States Patent
Degraeve et al.

(10) Patent No.: US 11,660,863 B2
(45) Date of Patent: May 30, 2023

(54) DROPLET EJECTION HEAD, MANIFOLD COMPONENT THEREFOR, AND DESIGN METHOD

(71) Applicant: Xaar Technology Limited, Cambridge (GB)

(72) Inventors: Sebastien Roger Gabriel Degraeve, Cambridge (GB); Colin Brook, Cambridge (GB)

(73) Assignee: Xaar Technology Limited, Cambridge (GB)

( * ) Notice: Subject to any disclaimer, the term of this patent is extended or adjusted under 35 U.S.C. 154(b) by 69 days.

(21) Appl. No.: 17/263,423

(22) PCT Filed: Jul. 26, 2019

(86) PCT No.: PCT/GB2019/052106

§ 371 (c)(1),
(2) Date: Jan. 26, 2021

(87) PCT Pub. No.: WO2020/021284

PCT Pub. Date: Jan. 30, 2020

(65) Prior Publication Data

US 2021/0291522 A1 Sep. 23, 2021

(30) Foreign Application Priority Data

Jul. 27, 2018 (GB) ..... 1812284

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2/14; B41J 2/14145; B41J 2/175
See application file for complete search history.

(56) References Cited

U.S. PATENT DOCUMENTS 3,211,088 A 12/1965 Naiman
4,272,200 A 9/1981 Hehl
(Continued)

FOREIGN PATENT DOCUMENTS

EP 0739735 A2 10/1996
EP 0867290 A2 9/1998
(Continued)

OTHER PUBLICATIONS

IP.com search (Year: 2022).*
(Continued)

*Primary Examiner* — Lisa Solomon
(74) *Attorney, Agent, or Firm* — Eric J. Sosenko; Jonathan P. O'Brien; Honigman LLP

(57) ABSTRACT

A manifold component for a droplet ejection head, the manifold component comprising: a mount for receiving an actuator component that provides one or more rows of fluid chambers, each chamber being provided with a respective at least one actuating element and a respective at least one nozzle, the at least one actuating element for each chamber being actuable to eject a droplet of fluid in an ejection direction through the corresponding at least one nozzle, each row extending in a row direction; a manifold chamber, which extends from a first end to a second end, and widens from said first end to said second end, the second end providing fluidic connection, in parallel, to at least a group of chambers within said one or more rows and being located adjacent said mount; and at least one port, each port opening into the manifold chamber at the first end thereof; wherein at least one portion between the first end and second end of the manifold chamber is shaped as a hyperbolic acoustic horn.

19 Claims, 16 Drawing Sheets

(56) References Cited

U.S. PATENT DOCUMENTS

| | | | |
|---|---|---|---|
| 5,781,212 | A | 7/1998 | Burr et al. |
| 6,193,356 | B1 | 2/2001 | Takata |
| 6,270,205 | B1 | 8/2001 | Takata |
| 7,311,380 | B2 | 12/2007 | Watanabe et al. |
| 2004/0165047 | A1 | 8/2004 | Takata |
| 2010/0171798 | A1 | 7/2010 | Yukuo et al. |
| 2014/0168328 | A1 | 6/2014 | Paschkewitz |
| 2015/0239243 | A1 | 8/2015 | Muraoka et al. |
| 2015/0239245 | A1 | 8/2015 | Long et al. |

FOREIGN PATENT DOCUMENTS

| | | | |
|---|---|---|---|
| EP | 1366901 | A1 | 12/2003 |
| EP | 1780018 | B1 | 2/2007 |
| EP | 2746051 | A1 | 6/2017 |
| JP | S 62-135378 | A | 6/1987 |
| JP | H1086374 | A | 4/1998 |
| JP | H 10-264376 | A | 10/1998 |
| JP | H11320877 | A | 11/1999 |
| JP | H11348302 | A | 12/1999 |
| JP | 2008201024 | A | 9/2008 |
| JP | 2010-158806 | A | 4/2010 |
| JP | 2013-010223 | A | 1/2013 |
| JP | 2014-117953 | A | 6/2014 |
| JP | 2015-157445 | A | 9/2015 |
| JP | 2016-128224 | A | 7/2016 |
| WO | 2017/149330 | A1 | 9/2017 |

OTHER PUBLICATIONS

Search Report dated Jan. 28, 2019, in the corresponding United Kingdom Application No. 1812284.6 (7 pgs.).

International Search Report dated Oct. 7, 2019, in International Application No. PCT/GB2019/052106 (12 pgs.).

Kolbrek Bjørn "Horn Theory: An Introduction, Part 1 and Part 2", audioXPRESS, Tube, Solid State, Loudspeaker Technology, pp. 1 to 8, 2008.

* cited by examiner

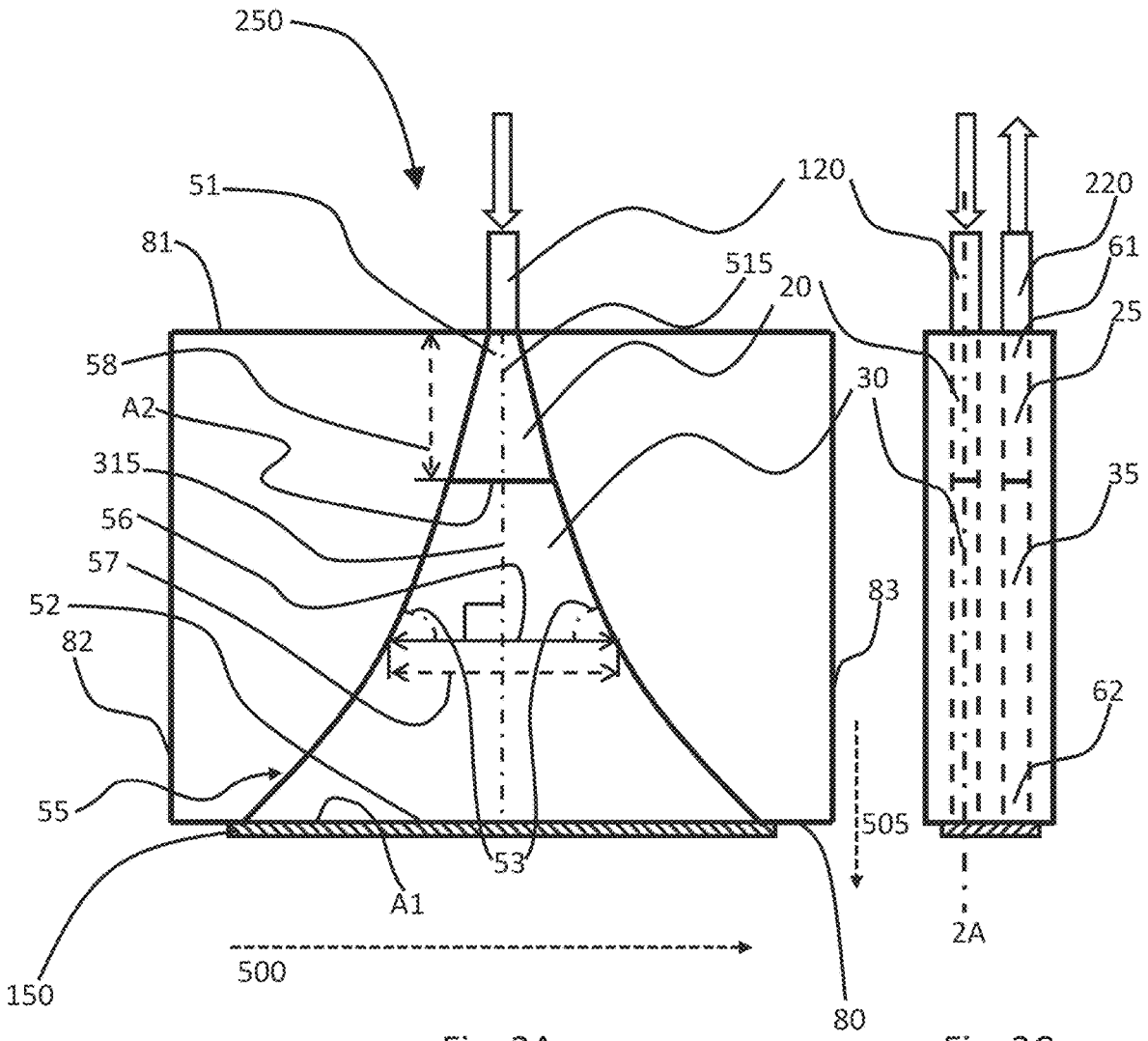
Fig. 2A
Fig. 2C
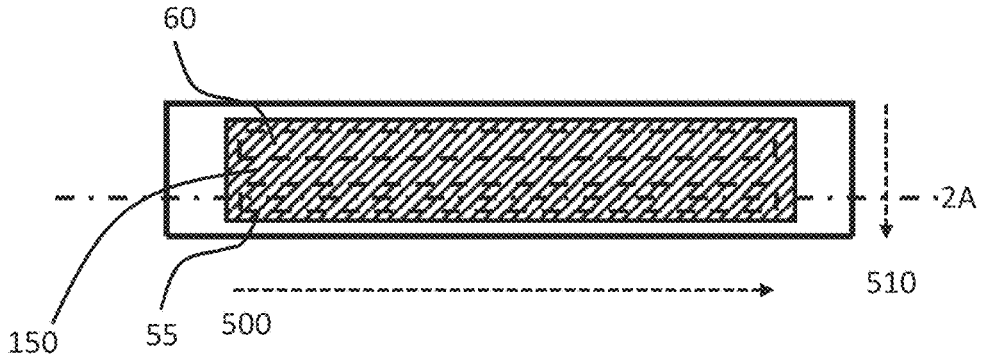
Fig. 2B

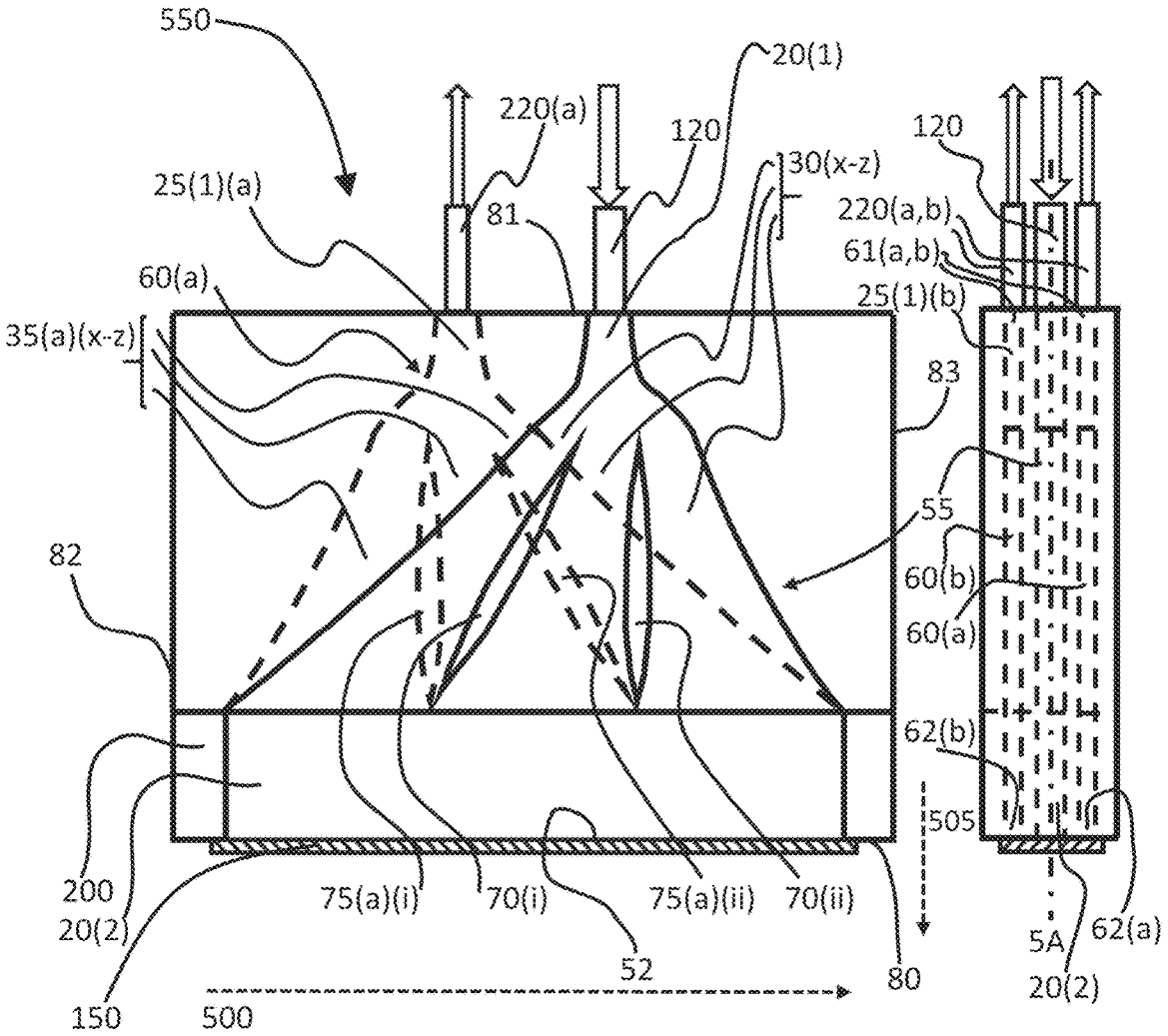
Fig. 5A
Fig. 5C
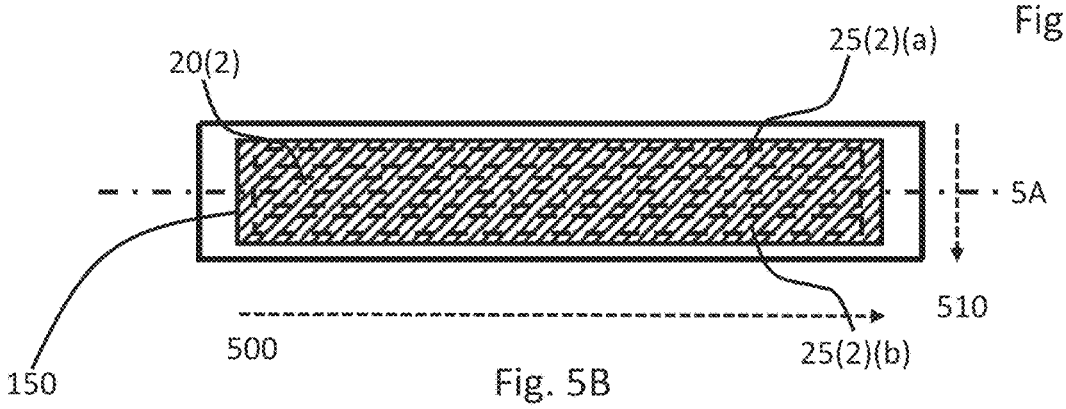
Fig. 5B

500

500

500

DROPLET EJECTION HEAD, MANIFOLD COMPONENT THEREFOR, AND DESIGN METHOD

CROSS REFERENCE TO RELATED APPLICATIONS

This application is a national stage entry of international application no. PCT/GB2019/052106, filed Jul. 26, 2019, which is based on and claims the benefit of foreign priority under 35 U.S.C. 119 to GB 1812284.6, filed Jul. 27, 2018. This entire contents of the above-referenced applications are herein expressly incorporated by reference.

The present invention relates to a manifold component for a droplet ejection head, and to an associated design method. It may find particularly beneficial application in a printhead, such as an inkjet printhead.

Droplet ejection heads are now in widespread usage, whether in more traditional applications, such as inkjet printing, or in 3D printing, or other rapid prototyping techniques.

Recently, inkjet printheads have been developed that are capable of depositing ink directly onto ceramic tiles, with high reliability and throughput. This allows the patterns on the tiles to be customized to a customer's exact specifications, as well as reducing the need for a full range of tiles to be kept in stock.

In other applications, droplet ejection heads may be used to form elements such as colour filters in LCD or OLED displays used in flat-screen television manufacturing.

Droplet ejection heads and their components continue to evolve and specialise so as to be suitable for new and/or increasingly challenging applications.

SUMMARY

Aspects of the invention are set out in the appended independent claims, while particular embodiments of the invention are set out in the appended dependent claims.

The following disclosure describes, in one aspect, a manifold component for a droplet ejection head, the manifold component comprising:

- a mount for receiving an actuator component that provides one or more rows of fluid chambers, each chamber being provided with a respective at least one actuating element and a respective at least one nozzle, the at least one actuating element for each chamber being actuable to eject a droplet of fluid in an ejection direction through the corresponding at least one nozzle, each row extending in a row direction;
- a manifold chamber, which extends from a first end to a second end, and widens from said first end to said second end, the second end providing fluidic connection, in parallel, to at least a group of chambers within said one or more rows and being located adjacent said mount; and
- at least one port, each port opening into the manifold chamber at the first end thereof;
- wherein at least one portion between the first end and second end of the manifold chamber is shaped as a hyperbolic acoustic horn.

The following disclosure describes, in another aspect, a manifold component for a droplet ejection head, the manifold component comprising one or more manifold chambers and at least one port; wherein a transitional portion connects one of said at least one ports to the second portion of said one or more manifold chambers and wherein said transitional portion comprises a change in cross-sectional shape to blend from the cross-sectional area of said one port to that of said second portion of said one or more manifold chambers.

BRIEF DESCRIPTION OF THE DRAWINGS

The invention will now be described with reference to the drawings, which are representational only and are not to scale, and in which:

FIG. 2A is a cross-sectional view of a manifold component according to another embodiment;

FIG. 2B is an end view of the manifold component shown in FIG. 2A;

FIG. 2C is a side view of the manifold component shown in FIGS. 2A and 2B;

FIG. 5A is a cross-sectional view of a manifold component according to yet another embodiment which has multiple horn-shaped portions;

FIG. 5B is an end view of the manifold component shown in FIG. 5A;

FIG. 5C is a side view of the manifold component shown in FIGS. 5A and 5B;

FIG. 7B(b) is a cross-sectional view of the manifold component depicted in FIG. 7B(a);

FIG. 7B(c) is a cross-sectional view of the manifold component 750 depicted in FIG. 7B(a) and (b);

FIG. 7B(d) is a cut-away three-dimensional view of a detail of the fluidic path depicted in FIG. 7B(a);

DETAILED DESCRIPTION OF THE DRAWINGS

Embodiments of the disclosure in general relate to a manifold component for a droplet ejection head.

Figure 1A:
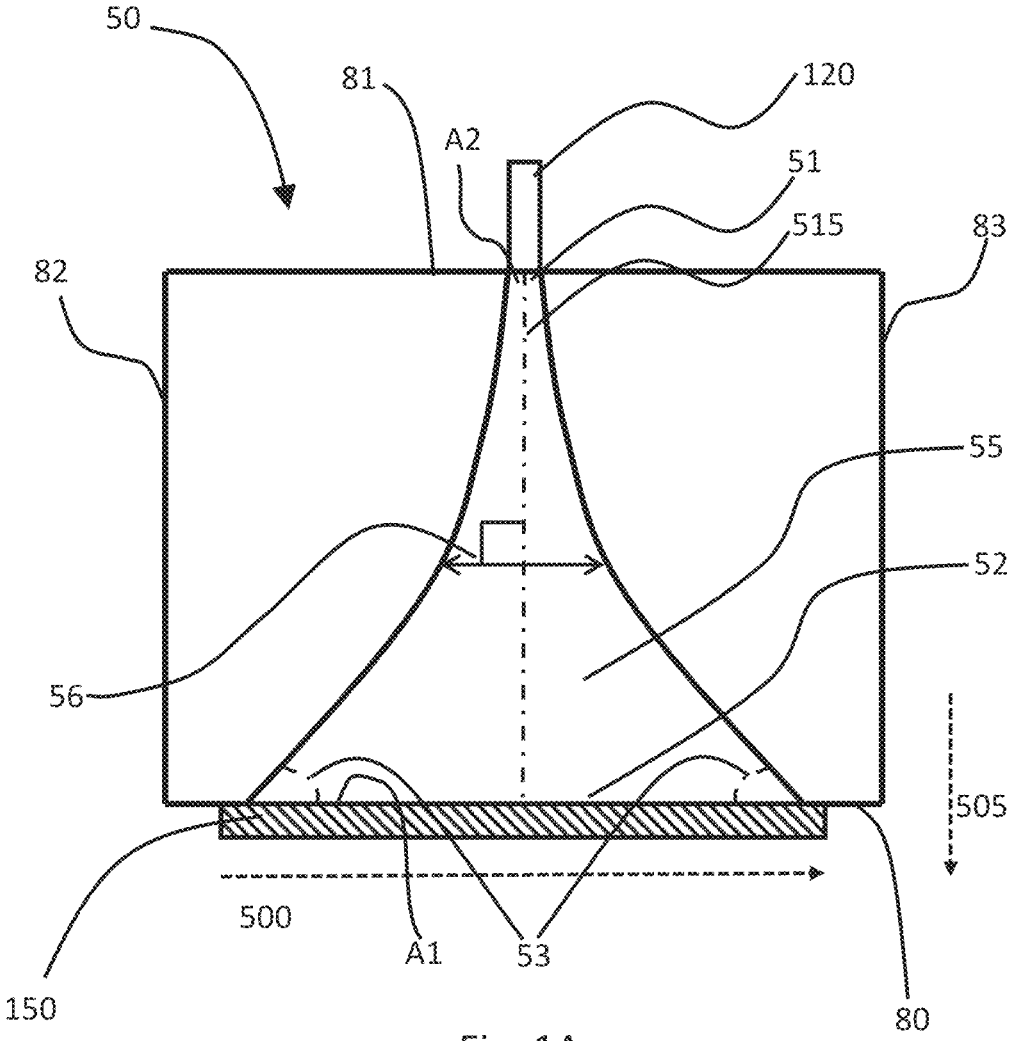
FIG. 1A is a cross-sectional view of a manifold component according to a first embodiment of the disclosure.
Figure 1B:
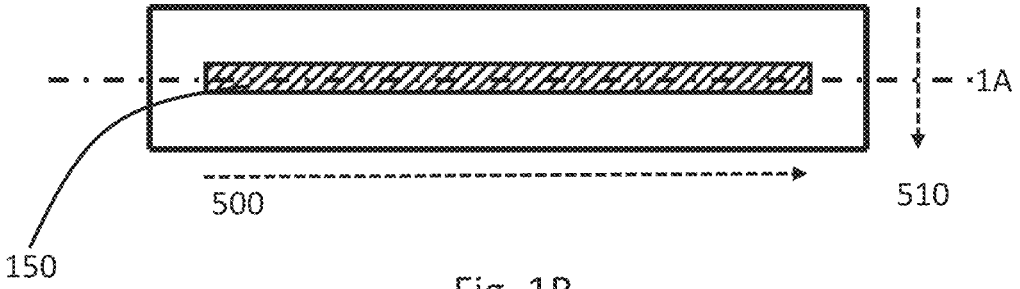
FIG. 1B is an end view of the manifold component shown in FIG. 1A.

Turning now to FIG. 1, shown is a manifold component 50 according to a first example embodiment. More particularly, FIG. 1A is a cross-sectional view of a manifold component 50 according to a first embodiment of the disclosure; FIG. 1B is an end view of the manifold component 50 shown in FIG. 1A. The example embodiment shown in FIG. 1A-B relates in general to a manifold component 50 for a droplet ejection head. The manifold component 50 has a mount 80 for receiving an actuator component 150 that provides one or more rows of fluid chambers (not shown). Each such chamber is provided with a respective at least one actuating element, for example a piezoelectric actuating element, and a respective at least one nozzle. In operation each actuating element is actuable to eject a droplet of fluid in an ejection direction 505 through the corresponding nozzle. Each of the rows of fluid chambers extends in a row direction 500, indicated with respective arrows in FIGS. 1A and 1B. In the particular example embodiment of FIGS. 1A and 1B, the mount 80 is a flat receiving surface.

As may be seen from FIG. 1A, a manifold chamber 55 is provided within the manifold component 50. The manifold chamber 55 extends from a first end 51 to a second end 52, widening from the first end 51 to the second end 52. Fluid flowing within the manifold chamber 55 during operation may be described as "fanning out" as it approaches the second end 52. The second end 52 provides a fluidic connection, in parallel, to at least a group of chambers within the one or more rows in the actuator component 150, the second end 52 being located adjacent to said mount 80. As may also be seen from FIG. 1A, the manifold component further includes a port 120 which opens into the manifold chamber 55 at the first end 51 thereof. In operation the port 120 may supply fluid to the first end 51 of the manifold chamber 55 such that the port 120 may be said to be an inlet port and the manifold chamber 55 may be said to be an inlet manifold chamber. In operation the fluid then passes through the inlet manifold chamber 55 from its first end 51 to its second end 52. For the manifold chamber 55, the entire portion between the first end 51 and the second end 52 thereof is shaped as a hyperbolic acoustic horn so as to assist in transferring acoustic waves away from the corresponding group of chambers in the actuator component 150. This may be referred to as the 'horn-shaped portion'. As shown representationally in FIG. 1, the cross-sectional area of the manifold chamber 55 may increase in a hyperbolic fashion from the first end 51 to the second end 52 so as to form a hyperbolic acoustic horn therein. The cross-sectional area of the hyperbolic horn-shaped portion of the manifold chamber 55 increasing in a hyperbolic fashion may, in operation, result in low levels of acoustic cross-talk between the fluid chambers of the actuator component 150. This may occur because a manifold chamber with a portion shaped as a hyperbolic acoustic horn may assist in transmitting acoustic waves (generated when one or more actuating elements are actuated) out of the manifold chamber 55 and into the fluidic supply. This may in turn improve the drop velocity and volume profile of the droplets of fluid ejected from the nozzles.

It has been calculated that when using a manifold component similar to that described in relation to FIG. 1 an improved acoustic performance may be expected. Furthermore, experiment-based tests for alternative embodiments (described later) have shown that an improved print quality may result. This may be explained as follows. When an actuating element is actuated to eject a droplet of fluid in an ejection direction 505, acoustic waves pass from the actuator component 150 back into the manifold chamber 55. Reflected waves may return to the actuator component 150 and influence the behaviour of the fluid in other fluid chambers in the actuator row, leading to non-uniform drop velocity and non-uniform drop volume and causing defects in the appearance of the printed image. Transmitting acoustic waves out of the manifold chamber 55 and into the rest of the fluidic system via the port 120 has now been shown to improve the consistency of the drop velocity and volume of droplets ejected from individual fluid chambers, and hence improve the appearance of the printed image or product.

It should be understood that an acoustic horn, similar to that shown in the embodiment of the manifold component 50 depicted in FIG. 1, includes a region whose cross-sectional area increases according to a hyperbolic equation connecting two cross-sectional areas A2 and A1, where A2 is the smaller area and A1 is the larger area. In the manifold component 50 depicted in FIG. 1, A2 is the cross-sectional area at the first end 51, proximate the port 120 and A1 is the cross-sectional area at the second end 52, proximate the mount 80. In the manifold component 50 the source of the acoustic waves of interest is one or more of the fluid chambers in the actuator component 150. In operation therefore acoustic waves would emanate from any fluid chamber where an actuating element is actuated and into the manifold chamber 55, e.g. travelling through the area A1 towards the area A2.

The changing cross-sectional area of the manifold chamber 55, indicated by arrow 56 in FIG. 1A, can be represented by equation (1) where A(x) is the calculated area of area 56 at a given position as x increases along the central path 515 from the area A2 to towards the area A1 and where x=0 is at the location of the area A2. Such regions of increasing cross-sectional area linking two different cross-sectional areas A2 and A1 are generally referred to as hyperbolic horns, also called hyperbolic-exponential or hypex horns.

Hypex horns are a general family of horns given by the wavefront area expansion:

$$A(x)=A2[\cos h(x/x_T)+T_\ \sin h(x/x_T)]\hat{}2 \quad (1)$$

where T is a parameter which sets the shape of the horn. For most practical applications $0 \leq T \leq 1$.

x_T is a reference distance given as:

$$x_T=c/(2\pi f_c) \quad (2)$$

where c is the speed of sound in the fluid and f c is the cutoff frequency. The cutoff frequency is the frequency below which most of the energy is reflected and above which most of the energy is transmitted.

Such equations may be used to design hypex horns as per any of the embodiments described herein. Depending on the desired operational capabilities of a droplet ejection head, it may be understood that different operating frequency ranges and acceptable cutoff frequencies may be required and may be designed for and chosen accordingly.

The manifold component 50 having a cross-sectional area changing in a hyperbolic fashion may therefore be described as follows. The manifold chamber 55 has a central path 515, which extends centrally through the manifold chamber 55 from the centre of the area A2 proximate the first end 51 to the centre of the area A1 proximate the second end 52. At any given point along the central path 515 the changing cross-sectional area is indicated by arrow 56 and is the area at right-angles to the central path 515. In the embodiment shown in FIG. 1 the central path 515 is parallel to the ejection direction 505, but this is in no way an essential feature. In the portion shaped as a hyperbolic acoustic horn the cross-sectional area of the area 56 varies according to a hyperbolic function of distance from the area A2 along the central path 515. In other words, the portion of the manifold chamber 55 which is shaped as a hyperbolic acoustic horn has a central path 515, which extends centrally through the manifold chamber, from the centre of the first end 51 of the manifold chamber 55 to the centre of the second end 52, the areas of cross-sections 56 taken perpendicular to the central path 515 vary approximately according to a hyperbolic function of distance from said first end 51 along the central path 515.

In some embodiments the cross-sectional area of the horn-shaped portion of the manifold chamber 55 increases according to an exponential function. As those skilled in the art will appreciate, a cross-sectional area increasing in an exponential fashion is a special case (with T=1) of a cross-sectional area increasing in a hyperbolic or hypex fashion and the manifold chamber 55 operates as an exponential acoustic horn.

It may be understood that the constraints of manufacturing an actual product and the imposition of manufacturing tolerances means that the manifold chamber 55 may not have an exactly mathematically true hypex (hyperbolic profile or exponential profile) for the horn-shaped portion. A horn-shaped portion with a profile that is close to or substantially hyperbolic may still provide improvements in ejection performance when used in the manifold chamber 55. The terms "hyperbolic fashion", "hyperbolic horn-shaped portion" and the like, including simply "horn-shaped", may therefore be understood to encompass a profile that is substantially hyperbolic. For example instead of having a smooth wall profile, a stepped horn-shaped portion consisting of multiple stacked cross-sections, each section having a discrete height in the ejection direction 505 may provide improvements in ejection performance when used in the manifold chamber 55. Such a profile may occur when using 3D printing, for example, to build up the manifold chamber 55 by depositing multiple layers. Moulded components may tolerate a degree of shrinkage and warpage during manufacture that alters the profile of the manifold chamber 55, for example, whilst still improving ejection performance. In general a certain amount of noise on the equation (1) may be tolerated when generating the profile for the walls of the manifold chamber 55 whilst still providing acceptable droplet ejection performance.

It may be understood that in other embodiments the hyperbolic horn-shaped portion may not extend through the entire manifold chamber 55, in which case the area A2 will be proximate the first end 51 of the manifold chamber 55, but not necessarily coincident with it, and the area A1 will be proximate the second end 52 of the manifold chamber 55, but not necessarily coincident with it.

As may be seen from FIG. 1B, in this embodiment the actuator component 150 is elongate such that its length in the row direction 500 is much greater than its depth in the depth direction 510. In some embodiments it may therefore be desirable that the second end 52 of the manifold chamber 55 is defined by an opening which is elongate parallel to the row direction 500 (for example, such that the opening has a long axis which extends in the row direction 500 and a short axis that extends in the depth direction). This may enable ready fluidic connection from the manifold chamber 55 to the actuator component 150. In some embodiments, the opening of the manifold chamber 55 at the second end 52 may have a point on each end of the long axis that defines the same angle 53 (see FIG. 1A) between the plane of the opening and the wall of the manifold chamber 55.

Furthermore, as can be also be seen from FIG. 1, in this embodiment the manifold component 50 and the manifold chamber 55 are likewise elongate, though this is by no means essential. Such an arrangement may be suitable when, for example, the manifold component 50 is part of an arrangement of multiple manifold components, for example so as to supply different colours for printing onto paper or fabric, or to enable dense printing of a single colour, as this shape enables close packing of multiple manifold components.

In the particular embodiment depicted in FIG. 1, the actuator component 150 is rectangular and the manifold chamber 55 has an opening that is rectangular in cross-section at its second end 52. However this is in no way limiting, and other arrangements of fluid chamber rows and shapes of actuator and manifold components are envisaged.

It may be readily understood that if the actuator component 150 is very long and slender then it may be expedient to use an array of manifold chambers 55 arranged adjacent to each other in the row direction 500 so that, in operation, each acts as an inlet manifold chamber 55 and supplies fluid to a portion of the actuator component 150. In such an arrangement each individual manifold chamber 55 would feed at least one group of fluid chambers within the one or more rows of fluid chambers in the actuator component 150. In some embodiments the second end 52 of the manifold chamber 55 may provide a fluidic connection, in parallel, to a corresponding one of said one or more rows of fluid chambers.

Turning now to FIG. 2, shown is a manifold component 250 according to another example embodiment. More particularly, FIG. 2A is a cross-sectional view of a manifold component 250, FIG. 2B is an end view of the manifold component 250 shown in FIG. 2A, and FIG. 2C is a side view of the manifold component 250 shown in FIGS. 2A and 2B. The embodiment shown in FIG. 2A-C is in many respects similar to that seen in FIG. 1 and thus, where appropriate, like reference numerals have been used.

Unlike the embodiment shown in FIG. 1, the manifold component 250 depicted in FIG. 2 does not have a horn-shaped profile over the entire length of the manifold chamber 55. Instead, as seen in FIG. 2A, the manifold chamber 55 includes a horn-shaped portion 30 and an additional (non-horn-shaped) portion 20 located between the first end 51 and the horn-shaped portion 30. The horn-shaped portion 30 is the portion of the manifold chamber 55 which has a cross-sectional area that increases in a hyperbolic fashion. The horn-shaped portion starts at the area A2 which is offset from the first end 51 of the manifold chamber 55 by a distance 58. The horn-shaped portion 30 may be described as commencing at the area A2 proximate the first end 51 and finishing at the area A1 proximate the second end 52. It should be appreciated that in embodiments where the hyperbolic portion starts at the first end 51, such as that depicted in FIG. 1, the area A2 and the first end 51 coincide, and there is no additional portion 20.

The portion of the manifold chamber 55 that increases in a hyperbolic fashion may in part be limited by the physical constraints of the wider droplet ejection head design, but in some embodiments the cross-sectional area of the at least one manifold chamber 55 may increase in a hyperbolic fashion over a majority of the distance between the first end 51 and the second end 52, i.e. the hyperbolic horn-shaped portion extends at least the majority of the distance between the first end 51 and the second end 52 of the corresponding manifold chamber 55. More particularly the cross-sectional area may increase in a hyperbolic fashion over a distance that is a fraction between 0.6 and 0.9 of the distance between the first end 51 and the second end 52, i.e. the hyperbolic horn-shaped portion may extend between 0.6 and 0.9 times the distance between the first end 51 and the second end 52 of the corresponding manifold chamber 55. In still other embodiments the cross-sectional area of the manifold chamber 55 may increase in a hyperbolic fashion over the entirety of the distance along the manifold chamber 55 between the first end 51 and the second end 52, i.e. the entire manifold chamber 55 is a hyperbolic horn (as shown in the embodiment depicted in FIG. 1). It should be understood that the term "distance" in this context refers to the distance between the first end 51 and the second end 52 along the central path 515 of the manifold chamber 55. It may further be understood that in the embodiments described herein the positions of A2 and A1 within the manifold chamber 55 depend on the extent and position relative to the first end 51 of the hyperbolic portion.

Like the embodiment illustrated in FIG. 1, the manifold component 250 in FIG. 2 also has an actuator component 150 that is elongate such that its length in the row direction 500 is greater than its depth in the depth direction 510 (see FIG. 2B). The manifold component 250 also has a manifold chamber 55 with an elongate opening parallel to the row direction 500 at the second end 52. The manifold component 250 differs from the manifold component 50 in FIG. 1 in that the cross-sectional area is elongate in the row direction 500 over the entire hyperbolic horn-shaped portion 30. In this case the cross-sectional area may be defined as the area 56 where the area 56 is elongate. As seen in FIG. 2A the angle 53 may be measured at opposing (short) ends of the elongate area 56 in the row direction 500. The area 56 is a portion of a plane that intersects with the bounding walls of the manifold chamber 55 at any given point between the area A2 and area A1 such that the angle 53 between the walls of the manifold chamber 55 and the plane of the cross-section is equal at the point of intersection on opposing ends of the manifold chamber 55. In other words, the manifold chamber 55 has at least two points on opposing ends of the elongate area 56 at least at the second end 52 that define the same angle 53 to the wall of said manifold chamber 55.

As can be seen from FIG. 2 the depth in the depth direction 510 of the hyperbolic horn-shaped portion 30 remains generally constant. The depth direction 510 is perpendicular to the row direction 500 and the ejection direction 505, as seen in FIGS. 2A and 2B. Since the depth of the horn-shaped portion 30 is generally constant, the hyperbolic change in cross-sectional area is largely due to increasing the width 57 in the row direction 500 of the horn-shaped portion 30. As seen in FIG. 2A, the central path 515 has a section, central path 315, which runs centrally through the horn-shaped portion 30 from the area A2 to the area A1. At each point on the central path 315 the width 57 is measured in a direction that is normal to the central path 315 at that point and that is perpendicular to the depth direction 510. The widths 57 vary generally according to a hyperbolic function with distance along the central path 315 from the area A2 to the area A1.

As can further be seen from FIG. 2A, as for the embodiment in FIG. 1 there is a port 120 located on surface 81 on the opposite side of the manifold component 250 to the mount 80 in the ejection direction 505. The port 120 in this embodiment has a circular cross-sectional area so as to enable ready connection to a fluidic supply system. The first end 51 of the manifold chamber 55 likewise has a circular cross-sectional area. As previously discussed the second portion 30 of the manifold chamber 55 may have a generally constant depth in the depth direction 510 and hence it may also be elongate along the entire central path 315. This means that the change in cross-sectional shape from circular to elongate occurs in the portion 20 of the manifold chamber 55 and the portion 20 is not a hyperbolic acoustic horn. In some embodiments the portion 20 may be limited in its extent such that the manifold chamber 55 may, for at least the majority of its extent thereof in the ejection direction 505, have a generally constant depth in the depth direction 510, which is perpendicular to the row direction 500 and to the ejection direction 505. As may be seen from FIGS. 2B and 2C, another significant difference to the embodiment in FIG. 1 is that the manifold component 250 in FIG. 2 has two manifold chambers, manifold chambers 55 and 60, whereas the manifold component 50 in FIG. 1 has only a single manifold chamber 55. As may be seen from FIG. 2C manifold chamber 60 is offset from manifold chamber 55 such that the two are adjacent to each other in the depth direction 510. Furthermore in this embodiment the geometric shape of the manifold chamber 60 is the same as that of the manifold chamber 55, but these are by no means essential features and other arrangements and geometries of manifold chamber are envisaged. In this implementation therefore, the portion 25 (which may be referred to herein as a "transitional portion") and the portion 35 of the manifold chamber 60 are the same geometric shape as the portion 20 and the portion 30 respectively of the manifold chamber 55. Also, the horn-shaped portion 35 starts at the area A2 which is offset from the first end 61 of the manifold chamber 60 by a distance 58 and ends at the second end 62 of the manifold chamber 60.

As can further be seen from FIG. 2C, in contrast to the embodiment shown in FIG. 1, the manifold component 250 of FIGS. 2A-2C includes two ports 120 and 220, whereas the manifold component 50 in FIG. 1 has only a single port 120. In the particular embodiment shown, these are located on surface 81, however it should be understood that this location is by no means essential. In operation, when the ports 120, 220 are fluidically connected to a suitable fluid supply, the manifold component 250 shown in FIGS. 2A-2C may be operated in a so-called "through-flow" mode such that droplet fluid may, in operation, flow continuously from the port 120 via the manifold chamber 55, the actuator component 150 and the manifold chamber 60 to the port 220, with port 120, manifold chamber 55, actuator component 150, manifold chamber 60 and port 220 being fluidically connected, in series, in that order. In operation, a portion of the fluid flowing through selected fluid chambers in the actuator component 150 may be ejected from the respective nozzles for those fluid chambers, whilst the remainder of the fluid continues through the individual fluid chambers and via the manifold chamber 60 to the port 220. In such embodiments the manifold chamber 55 is configured as an inlet manifold chamber where the corresponding port 120 is configured as an inlet port, in operation supplying fluid to the first end 51 of the inlet manifold chamber 55. The second end 52 of the inlet manifold chamber 55 in operation supplies fluid in parallel to each chamber within the corresponding group of fluid chambers in the actuator component 150. Furthermore, in such embodiments the manifold chamber 60 is configured as an outlet manifold chamber with the corresponding port 220 being configured as an outlet port that in operation receives fluid from the first end 61 of the outlet manifold chamber 60 in question. The second end 62 of the outlet manifold chamber 60, in operation, receives fluid in parallel from each chamber within the corresponding group of fluid chambers of the actuator component 150.

In alternative arrangements, in operation, fluid may be supplied to the actuator component 150 from both ports 120 and 220, whereby the droplet ejection head may be considered to operate in a non through-flow mode and the manifold chambers 55 and 60 are both inlet manifold chambers and the ports 120, 200 are both operating as inlet ports.

In the embodiment depicted in FIG. 2, the central path 515 is a straight line that is parallel to the ejection direction 505 owing to the geometry of the design depicted. In other embodiments, the central path 515 may not be a straight line but may follow a curved or serpentine path or any other path as defined by the shape of the manifold chamber 55, 60. Manifold chambers may be shaped in such a manner as a result of, for example, physical constraints elsewhere in the droplet ejection head, or to enable a ready connection to a fluidic supply. In such cases it may be appropriate, for example, to offset the port 120 and/or the port 220 from the centre of the manifold component 250 in the array direction 500, or even to locate the ports on one of the sides 82, 83 of the manifold component 250. In these cases, the central path 515 may follow a different route, for example at an angle to the ejection direction 505, depending on the shape of the manifold chamber 55, 60. In some embodiments the central path 515, which runs centrally through the manifold chamber in question, from the centre of the first end 51 to the centre of the second end 52, may not be parallel to the ejection direction 505 along some of its length. It may be desirable to ensure that the central path 515 is running generally parallel to the ejection direction 505 at the second end 52 of the manifold chamber in question, so as to improve fluidic performance by providing fluid flowing in a favourable direction to the actuator component 150. As may be readily understood, other shapes of manifold chamber 55, 60, and hence central path 515, are envisaged.

Figure 3A:
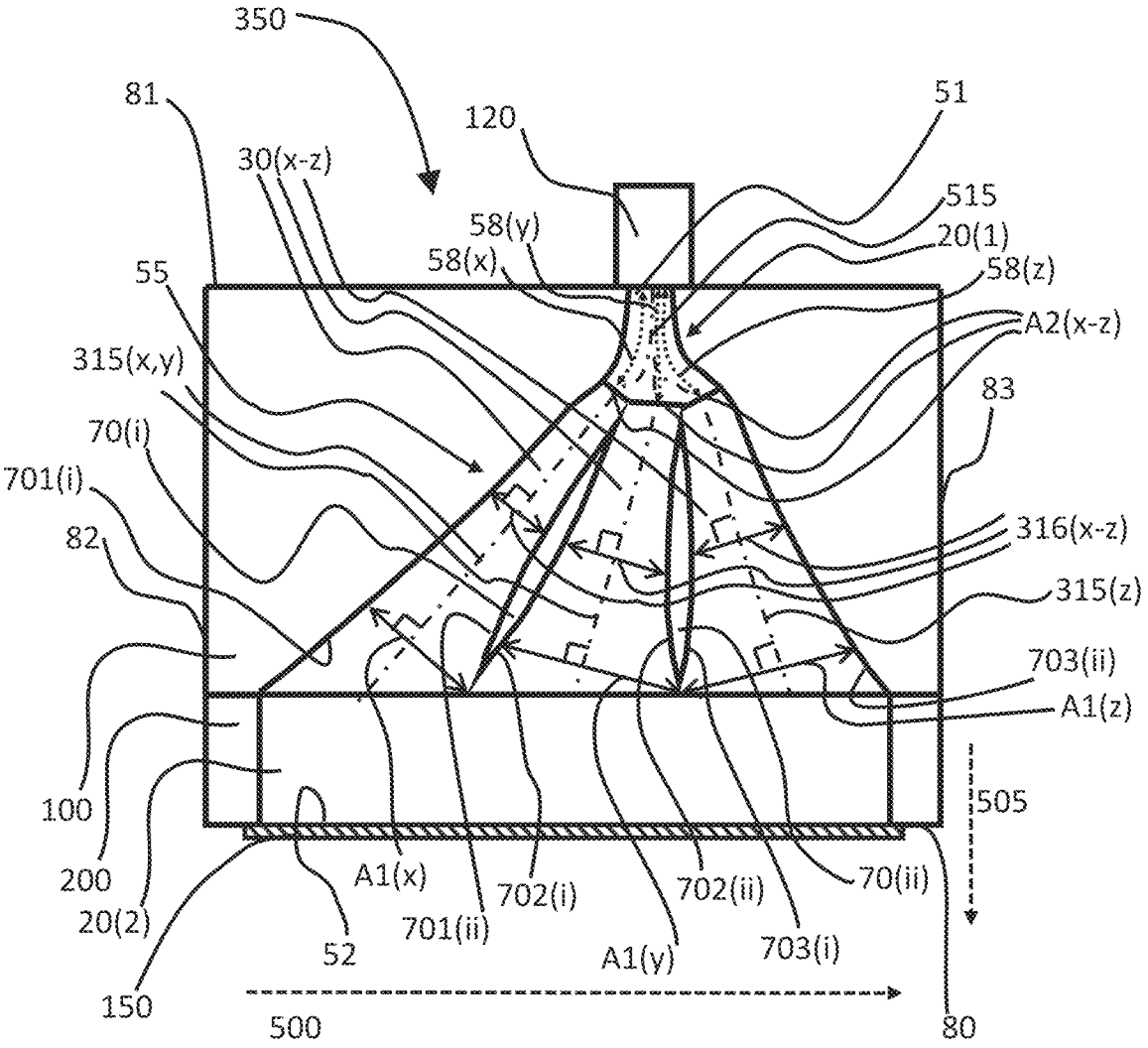
FIG. 3A is a cross-sectional view of a manifold component according to another embodiment which has multiple horn-shaped portions.
Figure 3B:
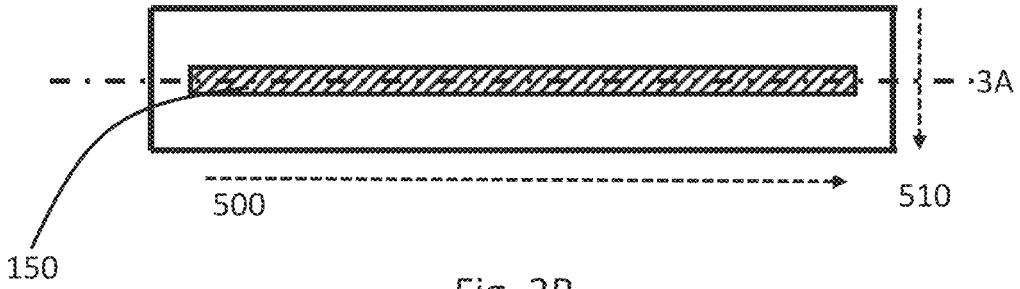
FIG. 3B is an end view of the manifold component shown in FIG. 3A.

Turning now to FIG. 3, shown is a manifold component 350 according to another example embodiment. More particularly, FIG. 3A is a cross-sectional view of a manifold component 350 and FIG. 3B is an end view of the manifold component 350 shown in FIG. 3A. Considering FIG. 3A it is clear that the manifold component 350 in this embodiment differs from the preceding two embodiments in that it comprises a plurality of hyperbolic horn-shaped portions 30(*x,y,z*), arranged side-by-side in an array. Such a design may be suitable where the actuator component 150 is long in the row direction 500, for example, and where a single horn-shaped portion to cover the entire actuator component in the row direction 500 may be too large in the ejection direction 505 to be practical. Using a plurality of hyperbolic horn-shaped portions allows the height of the manifold chamber 55 to be reduced and enables a more compact droplet ejection head to be manufactured. For example, it may be seen from FIG. 3A that the height of the manifold chamber 55 in the ejection direction 505 from its first end 51 to its second end 52 is comparatively equal to but less than the extent of the actuator component 150 in the row direction 500, giving a desirably compact arrangement.

As can be seen from FIG. 3A, the hyperbolic horn-shaped portions 30(*x,y,z*) are arranged side-by-side in an array whereby they are adjacent to each other in the row direction 500. The horn-shaped portions 30(*x,y,z*) each have a central path 315(*x,y,z*) respectively that splits from the central path 515 and respective areas 316(*x,y,z*) that are perpendicular to the respective central paths 315(*x,y,z*). It may be understood that the areas 316(*x,y,z*) of the horn-shaped portions 30(*x,y,z*) increase in a substantially hyperbolic fashion along the respective central paths 315(*x,y,z*) from the area A2(*x,y,z*) to the areas A1(*x,y,z*). As in the embodiment shown in FIG. 2, the embodiment in FIG. 3 includes hyperbolic portions that don't commence at the first end 51 of the manifold chamber 55. Suitable spatial offsets 58(*x,y,z*) allow for the central path 515 splitting and forming the respective central paths 315 (*x,y,z*). It should be understood that, owing to design constraints, the offsets 58(*x,y,z*) may not be the same as each other but rather may be determined according to the shape, location, orientation, etc. of the horn-shaped portions 30(*x, y,z*) and/or their respective central paths 315(*x,y,z*) and/or the path to each of their respective areas A2(*x,y,z*) from the first end 51. It may be understood that in practice the hyperbolic equation for each horn-shaped profile may more readily be determined by setting x=0 individually for each, located in the centre of their respective area A2(*x,y,z*).

The cross sectional area of each horn-shaped portion 30(*x,y,z*) may be defined as follows. The hyperbolic acoustic horns may each have a corresponding central path 315(*x,y,z*), which extends centrally through portions 30(*x,y,z*), from the centre of the area A2(*x,y,z*) to the centre of the area A1(*x,y,z*). At each point along the central paths 315(*x,y,z*) there is defined a corresponding cross-sectional area, area 316(*x,y,z*), which is the area lying within a plane perpendicular to the central path 315(*x,y,z*) and bounded by the walls of the hyperbolic acoustic horn, which may be part of the inner surface of the manifold chamber 55 and one side of one of the plurality of walls 70(*i,ii*) or two sides of two opposing walls amongst the plurality of walls 70(*i,ii*). The cross-sectional area of the area 316(*x,y,z*) varies approximately according to a hyperbolic function of distance from the Area A2(*x,y,z*) along the central path 315(*x,y,z*).

As may also be seen from FIG. 3A, neighbouring horn-shaped portions 30(*x,y*) are separated by a corresponding wall 70(*i*) located within the manifold chamber 55, and likewise neighbouring horn-shaped portions 30(*y,z*) are separated by a corresponding wall 70(*ii*) also located within the manifold chamber 55. As is apparent from FIG. 3A, each of the walls 70(*i,ii*) extends over only part of the distance between the first end 51 and the second end 52 of the manifold chamber 55. The horn-shaped portions 30(*x,y,z*) comprise first (701-703)(*i*) and second (701-703)(*ii*) side surfaces, which are spaced apart in said row direction 500, said side surfaces 701-703(*i,ii*) being substantially concave. The first (701-703)(*i*) and second (701-703)(*ii*) side surfaces are formed from amongst the edges of the walls 70(*i*) and 70(*ii*) and the sides of the manifold chamber 55; such that first side surface 701(*i*) and second side surface 701(*ii*) bound horn-shaped portion 30(*x*), first side surface 702(*i*) and second side surface 702(*ii*) bound horn-shaped portion 30(*y*), and first side surface 703(*i*) and second side surface 703(*ii*) bound horn-shaped portion 30(*z*). It may be understood that the constraints of manufacturing an actual product and the imposition of manufacturing tolerances means that the horn-shaped portions 30(*x,y,z*) may not have a mathematically true hyperbolic or exponential profile. For example, while the walls 70(*i,ii*) are depicted as having sharp or pointed ends, this is purely representational and it should be understood that, in practice, the ends might, for example, be blunted or chamfered in order to facilitate manufacture. A profile or shape that is close to or substantially hyperbolic or that changes in a hyperbolic fashion may still, for example, provide desirable print performance when used in the horn-shaped portions 30(*x,y,z*) of a manifold component 350 for a drop-on-demand printhead. For example, for manufacturing reasons a design constraint may be to limit the walls 70(*i,ii*) such that they may not be less than a certain thickness, for example 400 micrometers, and fillets or other smoothing features may be necessary at the tips of the walls.

It should be appreciated that, while the particular embodiment shown in FIG. 3A includes two walls 70(*i,ii*) and three horn-shaped portions 30(*x,y,z*) this is by no means essential and alternative embodiments may comprise any suitable number of horn-shaped portions and corresponding dividing walls. In other embodiments it may be desirable for fluidic reasons to have the plurality of horn-shaped portions staggered, by altering the positions of the walls in the ejection direction 505, or other suitable arrangements to aid smooth fluidic flow from the first portion 20 into the plurality of horn-shaped portions.

In the embodiment depicted in FIG. 3A the walls 70(*i,ii*) are elongate and curved, and shaped appropriately to provide a suitable hyperbolic profile to the horn-shaped-portions 30(*x,y,z*) between the areas A2(*x,y,z*) and A1(*x,y,z*). A manifold component 350 featuring such walls 70(*i,ii*) might, for example, be manufactured using 3D printing techniques since it may be easier to manufacture such slender internal features using this method as compared to conventional casting, molding or machining techniques. A 3D printed component may also be easy to make without seams and fluid-tight, reducing leakage problems in a droplet ejection head. However, while the use of slender walls is described to partition the horn-shaped manifolds 30(*x,y,z*), other embodiments may instead use much wider walls or other physical features and the manufacturing technique could comprise forming several separate components, for example, and joining them together in any suitable fashion so as to form a single, fluid-tight manifold component 350.

As may be seen from FIG. 3A, each of the horn-shaped portions 30(*x,y,z*) is positioned so as to overlap with a section of the second end 52 of the manifold chamber 55 in the row direction 500. In operation each horn-shaped portion 30(*x,y,z*) preferentially provides a fluidic connection, in parallel, to a respective group of chambers within the one or more rows in the actuator component 150. In this embodiment the horn-shaped portions divide the second end 52 into three equal sections. For example, if there are 300 fluid chambers in the row direction 500, each of the horn-shaped portions 30(*x,y,z*) will, in operation, largely supply fluid to a group of 100 fluid chambers most closely adjacent to its position. Since the walls 70(*i,ii*) do not extend into the slot 201, there is the possibility of some fluid intermixing therein, so it may be understood that in operation the number of fluid chambers each horn-shaped portion 30(*x,y,z*) supplies may not be precisely 100 and there may be some overlap near the wall 70(*i,ii*) positions. It should be further understood that 300 fluid chambers is merely an example; in some embodiments there may be fewer or far greater numbers of fluid chambers.

It should be understood that in other embodiments there may be any number of horn-shaped portions. It may further be understood that in a design with a plurality of horn-shaped portions, that these are not necessarily identical. For example the horn-shaped portions could be of different sizes so as to divide the second end 52 into equal or unequal sections and that therefore the horn-shaped portions may supply equal or unequal sized groups of fluid chambers. As another example, a plurality of non-identical horn-shaped portions may be used to account for asymmetry in the manifold chamber 55. For example, as seen in FIG. 3A, the port 120 is located on the surface 81 at a position offset from the centre of the manifold component 350 in the row direction 500 (unlike the embodiments in FIGS. 1 and 2). This is by no means essential, but may be suitable in some embodiments for ease of connection to other components such as a fluidic supply. As a result, as may also be seen in FIG. 3A, the manifold chamber 55 connecting the port 120 to the actuator component 150 is asymmetric and the horn-shaped portions 30(*x,y,z*) are shaped accordingly such that they are not identical.

The manifold component 350 in FIG. 3 is similar to the embodiment depicted in FIG. 1 in that it includes a single manifold chamber 55. However, it is similar to the embodiment in FIG. 2 in that it includes a manifold chamber 55 which is divided into a (non-horn-shaped) portion 20(1) proximate the port 120 and a horn-shaped portion 30 proximate the actuator component 150. As for the manifold component 250 in FIG. 2, the embodiment depicted in FIG. 3 includes a change in cross-sectional shape, from circular to match the port 120, to elongate to match the actuator component 150 within the portion 20(1). Furthermore, as for the embodiment depicted in FIG. 2, the manifold component 350 of FIG. 3 includes horn-shaped portions 30(*x,y,z*) that have an elongate cross-sectional area in the row direction 500.

It can be further seen in FIG. 3A that the manifold component 350 comprises two parts that have been joined together, first manifold section 100 and second manifold section 200, with the mount 80 now located on the lower surface of the second manifold section 200 in the ejection direction 505. The actuator component 150 is mounted on the mount 80. This is in no way an essential feature, but may be useful in some embodiments to aid in securely connecting the actuator component 150 to the manifold component 350, or for improving the longevity of the actuator component 150, or for improving the assembly process. For example, if the first manifold section 100 is made from a material such as a resin or a thermosetting plastic or a plastic/fibre composite material for ease of manufacture or cost reasons, it may have different thermal properties to the actuator component 150 which may be manufactured largely from a silicon or piezoceramic material. The second manifold section 200 may be made of a material such as a ceramic or a metal that more closely matches the thermal properties of the actuator component 150 than the first manifold section 100, and may reduce stresses induced in the actuator component 150 during assembly or operation.

FIG. 3A also shows that the second manifold section 200 has a slot 20(2) therein, fluidically connecting the horn-shaped portions 30(*x,y,z*) to the second end 52 of the manifold chamber 55 and hence to the actuator component 150. It may be understood that such a second manifold section 200 is in no way an essential feature and in many embodiments suitable thermal matching may be encompassed within a single manifold component as depicted in FIGS. 1 and 2 and/or within the actuator component 150.

As may also be seen from FIG. 3A, the areas A1(*x,y,z*) and the second end 52 do not coincide. The slot 20(2) is a non-hyperbolic portion connecting the horn-shaped portions 30(*x,y,z*) to the second end 52 of the manifold chamber 55. In operation the slot may allow for some fluidic mixing between the fluid exiting the horn-shaped portions and entering the actuator component 150 and may also act as a flow straightener, in operation aligning and directing the fluid flow so that it is more closely parallel with the ejection direction 505 at the second end 52. It may also act to flatten the velocity profile along the row direction 500 such that the fluid supplied to the actuator component 150 is at a more uniform velocity.

Figure 4:
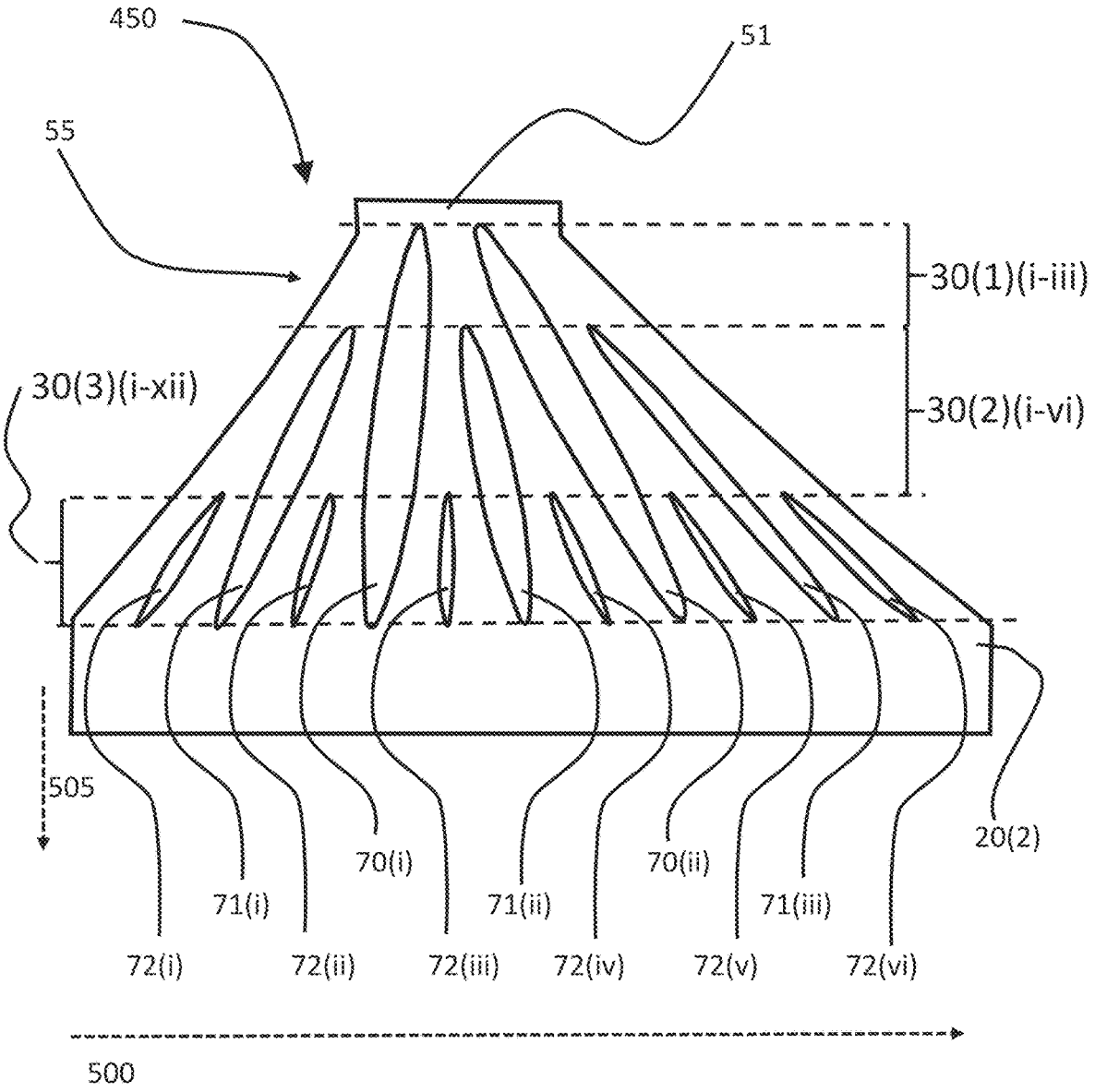
FIG. 4 is a manifold component according to another embodiment.

FIG. 4 shows a manifold component according to another embodiment. Specifically, FIG. 4 depicts a manifold component 450 with a manifold chamber 55 comprising a hierarchical arrangement of a plurality of hyperbolic horn-shaped portions 30(1)(*i-ii*), 30(2)(*i-vi*) and 30(3)(*i-xii*) which are divided by a plurality of walls 70(*i-ii*), 71(*i-iii*) and 72(*i-vi*); where, unlike the embodiment depicted in FIG. 3, not all of the walls extend over the entirety of the portion 30. Such a design may be suitable, for example, where the actuator component 150 is long in the row direction 500, and there is a requirement for multiple horn-shaped portions owing to space constraints in the ejection direction 505. Another reason to have a hierarchical arrangement of a plurality of hyperbolic horn-shaped portions may be when there is insufficient room at the apex of the manifold chamber 55 proximate the first end 51 to fit the plurality of walls owing to manufacturing constraints such as a minimum wall thickness. Introducing increasing numbers of walls as the manifold chamber 55 widens in the ejection direction 505 may overcome this constraint. Another reason to stagger the introduction of the walls may be where, for example, the fluidic design requires a minimum gap in the row direction 500 between the walls proximate the first end 51. This may be desired in order to ensure that there is smooth unhindered fluidic flow into the horn-shaped portions but where there are space constraints on the length in the array direction 500 of the first end 51.

It can be seen from FIG. 4 that some of the walls 70(*i,ii*) extend through all three of the hierarchical portions 30(1)(*i-ii*), 30(2)(*i-vi*) and 30(3)(*i-xii*), some through two of the hierarchical portions (walls 71(*i-iii*)) and the remainder are only in the final hierarchical portion (walls 72(*i-vi*)). Such an arrangement may make design and manufacture easier, but is by no means essential. In some embodiments different arrangements of walls may be used to separate the hierarchical portions, for example an arrangement whereby each wall extends only part of the distance from the first end 51 to the second end 52 of the corresponding manifold chamber 55 is envisaged.

A manifold component 450 as depicted in FIG. 4 comprising a plurality of said arrays of side-by-side horn-shaped portions, may include an initial array of side-by-side horn-shaped portions 30(1)(*i-ii*), which is proximate the first end 51 of the inlet manifold chamber 55, and a final array of horn-shaped portions 30(3)(*i-xii*), which is proximate the second end 52 of the inlet manifold chamber 55, said arrays being arranged consecutively from the first end 51 to the second end 52 of the manifold chamber 55, with the number of horn-shaped portions in each array increasing progressively from said initial array 30(1) to said final array 30(3). Furthermore the plurality of horn-shaped portions 30(1)(*i-ii*), 30(2)(*i-vi*) and 30(3)(*i-xii*) is arranged hierarchically, such that a horn-shaped passageway in a given one of said arrays is fluidically connected to two or more horn-shaped passageways in the consecutive array nearer the second end 52 of the manifold chamber 55. At each hierarchical portion 30(1)(*i-ii*), 30(2)(*i-vi*) or 30(3)(*i-xii*) in the manifold chamber 55, neighbouring (in the row direction 500) horn-shaped portions in the plurality of arrays are separated by a corresponding wall, located within the manifold chamber 55 in question.

The final stage in the hierarchical arrangement depicted in FIG. 4, horn-shaped portion 30(3)(*i-xii*) is divided into twelve portions at the ends of the walls proximate the second end 52. Furthermore it may be preferable for acoustic reasons not to have the width proximate the second end 52 of any individual horn-shaped portion greater than one twelfth of the overall width at that point in the row direction 500. In other words, the width, in the row direction 500, of each horn-shaped portion is less than 1/12 of the width, in the row direction 500, of the second end 52 of the manifold chamber 55. This may improve acoustic performance by rejecting the first lateral resonance frequency. It may be understood that twelve horn-shaped portions is due to the length of the actuator component 150 and the speed of sound c in a typical fluid for an droplet ejection head for inkjet printing. The number of horn-shaped portions desired may differ depending on the length of the actuator component 150 in the row direction 500 and the speed of sound in the ejection fluid being used. Furthermore it may be preferable for acoustic reasons that all of the horn-shaped portions 30(3)(*i-xii*) are of equal length in the row direction at the end proximate the second end 52 of the manifold chamber 55.

Turning now to FIG. 5, shown is a manifold component 550 according to another example embodiment. More particularly, FIG. 5A is a cross-sectional view of a manifold component 550, FIG. 5B is an end view of the manifold component 550 shown in FIG. 5A and FIG. 5C is a side view of the manifold component 550 shown in FIGS. 5A and 5B. It can be seen from FIG. 5A that the manifold component 550 has a manifold chamber 55 similar to the embodiment shown in FIG. 3. It can also be seen from FIG. 5C that there are two further manifold chambers 60(*a,b*), partially overlapping the manifold chamber 55 in the depth direction 510. It can be seen from FIG. 5A that the manifold chamber 60(*a*) is a reversed geometrical copy of the manifold chamber 55 and has a plurality of horn-shaped portions 35(*a*)(*x,y,z*) arranged side-by-side, or adjacent to each other, in the row direction 500. Although not shown in FIG. 5A, the second manifold chamber 60(*b*) is identical to the first manifold chamber 60(*a*) and located on the opposite side of the manifold chamber 55 to it in the depth direction 510. Throughout the following description like reference numerals are used for the component parts of the two manifold chambers 60(*a,b*) with (a) or (b) appended accordingly.

The embodiment depicted in FIG. 5 is an arrangement, similar to that shown in FIG. 2, which allows so-called "through-flow" of fluid when connected to a suitable fluidic supply. In operation therefore, the port 120 can operate as an inlet port, the manifold chamber 55 can act as an inlet manifold chamber and the manifold chambers 60(*a,b*) can operate as outlet manifold chambers with the ports 220(*a,b*) operating as outlet ports. The main difference, as compared to the embodiment depicted in FIG. 2 which has one inlet manifold chamber 55 and one outlet manifold chamber 60, is that there is a ratio of two outlet manifold chambers 60(*a,b*) to one inlet chamber 55 in the embodiment of FIG. 5.

In the arrangement shown in FIG. 5, the actuator component 150 has two rows of fluid chambers (not shown) extending parallel to each other in the row direction 500. As before each fluid chamber in a row may be provided with at least one respective actuating element and at least one respective nozzle, each actuating element being actuable to eject a droplet of fluid in an ejection direction 505 through the corresponding at least one of the nozzles. This example arrangement would therefore have at least two rows of nozzles, each row corresponding to a particular row of fluid chambers.

In operation in through-flow mode the manifold component 550 depicted in FIG. 5 can allow fluid to pass from the inlet port 120 via the inlet manifold chamber 55 to the actuator component 150 where the fluid path will split such that some of the fluid will pass into the first row of fluid chambers, via individual inlets to each fluid chamber therein, while the other part of the fluid will pass through the second row of fluid chambers, via individual inlets to each fluid chamber in the other row. Part of the fluid passing into the chambers may be ejected in the form of droplets, while the remainder will exit the chambers via respective fluid chamber outlets. The fluid chamber outlets of the first row are fluidically connected to the outlet manifold chamber 60(*a*) and hence to the outlet port 220(*a*). The fluid chamber outlets of the second row are fluidically connected to the outlet manifold chamber 60(*b*) and hence to the outlet port 220(*b*). When operating the embodiment depicted in FIG. 5 in through-flow mode it may be preferable that the fluid split is balanced such that half the fluid follows one path through the manifold component 550 and half the fluid follows the other path.

In operation, a portion of the fluid passing through any individual fluid chamber may be ejected depending on the drive signals supplied by wiring (not shown) to the actuating element(s). The outlet ports 220(*a,b*) may be connected in some manner to a single fluidic outlet path to remove the fluid from the manifold component 550, or they may be separately connected to individual fluidic outlet paths. Since in the example shown in FIG. 5 there is a single port 120 and a single inlet manifold chamber 55 it is apparent that this arrangement will, in operation, supply a single fluid type to both the rows of fluid chambers and so both rows of nozzles will eject the same fluid type. This arrangement may allow for close packing of nozzle rows within the actuator component 150 and may be appropriate, for example, where there are space constraints and/or where a high nozzle density is required to form a high resolution droplet ejection head. In the embodiment depicted in FIG. 5, the second end 52 of the inlet manifold chamber 55 provides a fluidic connection, in parallel, to two rows of fluid chambers, whilst each of the outlet manifold chambers 60(*a*) and 60(*b*) provides a fluidic connection, in parallel, to one row of fluid chambers.

As can be seen from FIG. 5A, like the embodiment depicted in FIG. 3, the manifold component 550 comprises first and second manifold sections 100, 200. The second manifold section 200 located between the first manifold section 100 and the actuator component 150. The second manifold section 200 has three slots, one slot 20(2) fluidically connects the horn-shaped portions 30(*x,y,z*) to the second end 52 of the inlet manifold chamber 55 and then to the actuator component 150. Two further slots 25(2)(*a*) and 25(2)(*b*), one either side of slot 20(2) in the depth direction 510, fluidically connect the second ends 62(*a,b*) of the outlet manifold chambers 60(*a,b*) to the horn-shaped portions 35(*a,b*)(*x,y,z*).

As previously discussed with regard to the embodiment depicted in FIG. 3, each inlet horn-shaped portion 30(*x,y,z*), is located so as to cover a portion of the second end 52 in the row direction 500 such that each provides a fluidic connection, in parallel, to a respective group of chambers within the one or more rows in the actuator component 150. Similarly the outlet horn-shaped portions 35(*a,b*)(*x,y,z*) are located so as to provide fluidic connection, in parallel, to respective groups of chambers within the one or more rows in the actuator component 150. In operation each outlet horn-shaped portion 35(*a,b*)(*x,y,z*) will largely be receiving fluid from a respective group of fluid chambers adjacent to it in the row direction 500. However, since the walls 75(*a,b*)(*i,ii*) do not extend into the slots 25(2)(*a,b*) there is the possibility of some fluid intermixing therein.

In alternative arrangements, fluid may be supplied to the actuator component 150 from all three ports 120 and 220 (*a,b*), such that the droplet ejection head may be considered to operate in a non through-flow mode.

Figure 6A:
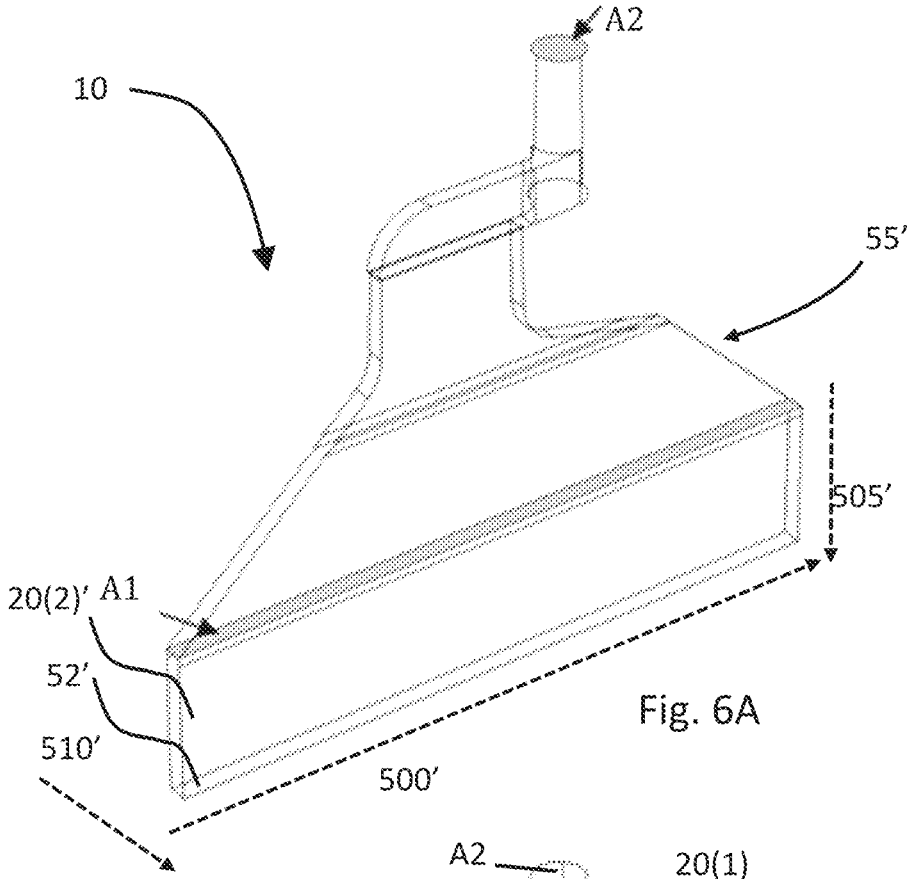
FIG. 6A is the fluidic path in a manifold component according to a first test design.
Figure 6B:
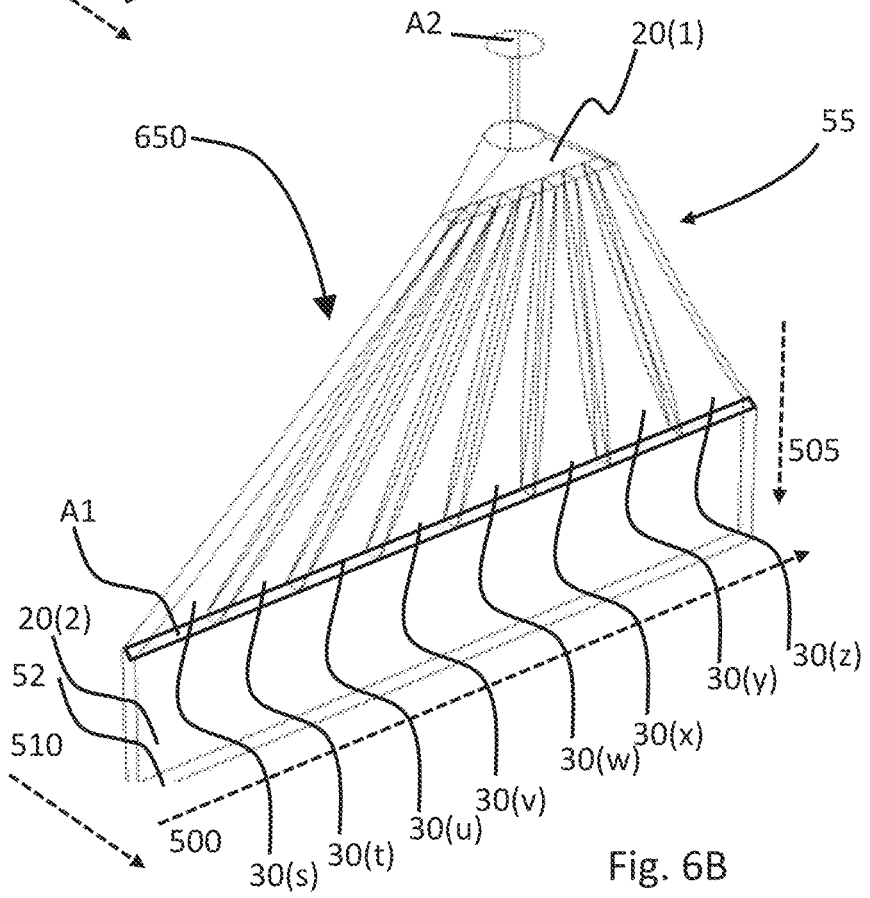
FIG. 6B is the fluidic path in a manifold component according to another embodiment with multiple horn-shaped portions.
Figure 6C:
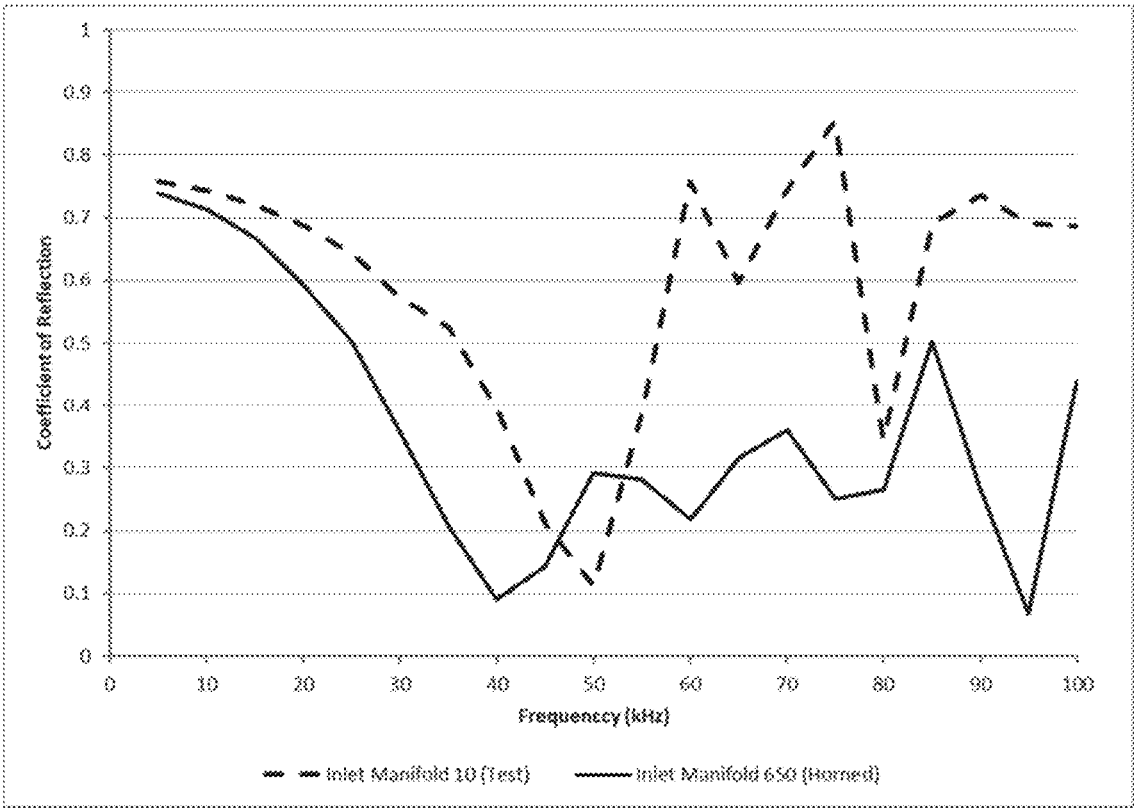
FIG. 6C compares the calculated performance of the manifold components in FIGS. 6A and 6B.

Attention is now directed to FIGS. 6A-C, in which: FIG. 6A is the inlet-only fluidic path in a manifold component 10 according to a first test design; FIG. 6B is the fluidic path in a manifold component 650 according to a further embodiment; and FIG. 6C is a graph that compares the calculated performance of the manifold components 10 and 650. As can be seen in FIG. 6B, the manifold component 650 is an embodiment similar to that in FIG. 3 where there the manifold chamber 55 is an inlet manifold chamber 55 and there are a plurality of horn-shaped portions 30(*s-z*). Such embodiments might be described as including a multicellular acoustic horn, or might be described as multicellular 'horned' manifolds. Also, as for the manifold components in FIGS. 2 and 3, the embodiment depicted in FIG. 6B comprises a change in cross-sectional shape, from circular to match the port 120, to elongate to match the actuator component 150 within the portion 20(1).

As may be seen by comparing FIGS. 6A and 6B, whilst the test design and the horned manifold component differ in that the former is not a hyperbolic acoustic horn and the latter has multiple acoustic horns, both the test design and the horned manifold component were designed to share certain features. The manifold chambers 55' and 55 in the test manifold component 10 and the horned manifold component 650 both have a rectangular second end 52',52 of the manifold chambers 55', 55 and the inlet port opens at the same location relative to the second ends 52', 52 of the manifold chambers 55', 55.

Attention is now directed to FIG. 6C, which is a graph showing the coefficient of reflection for acoustic pressure waves for the manifold components 10, 650 illustrated in FIGS. 6A and 6B as the frequency of ejection is varied. The coefficient of reflection was calculated using Finite Element analysis to investigate the response of a horned manifold as per FIG. 6B and a test manifold as per FIG. 6A. The calculations were performed using the rigid piston assumption, to perform a frequency sweep from 0 to 100 kHz. The rigid piston was located at the second ends 52, 52' at a position analogous to that of the actuator component 150.

As can be seen in FIG. 6C, a coefficient of reflection of 0 corresponds to no reflection, where all acoustic waves are transmitted out of the manifold component through the cross-sectional area A2. A coefficient of reflection of 1 means that there is no transmission and all of the acoustic waves are reflected back to the cross-sectional area A1. For a droplet ejection head design that utilises one or other of the manifold components 10 (test) and 650 (horned), the frequency range considered is 0 to 100 kHz, where 0-100 kHz is the droplet ejection frequency (100 kHz is the upper frequency limit for the droplet ejection head of the present embodiment). Preferably, a manifold component for a droplet ejection head would have a coefficient of reflection as low as possible over the considered frequency range 0 to 100 kHz. It may be seen from FIG. 6C, that for the horned manifold component 650 the coefficient of reflection is reduced across a substantial part of the considered range as compared to the test manifold component 10. It may be understood that for droplet ejection heads with different frequency conditions/requirements, an improved manifold component may be designed for a different upper frequency limit than 100 kHz.

Figure 7A:
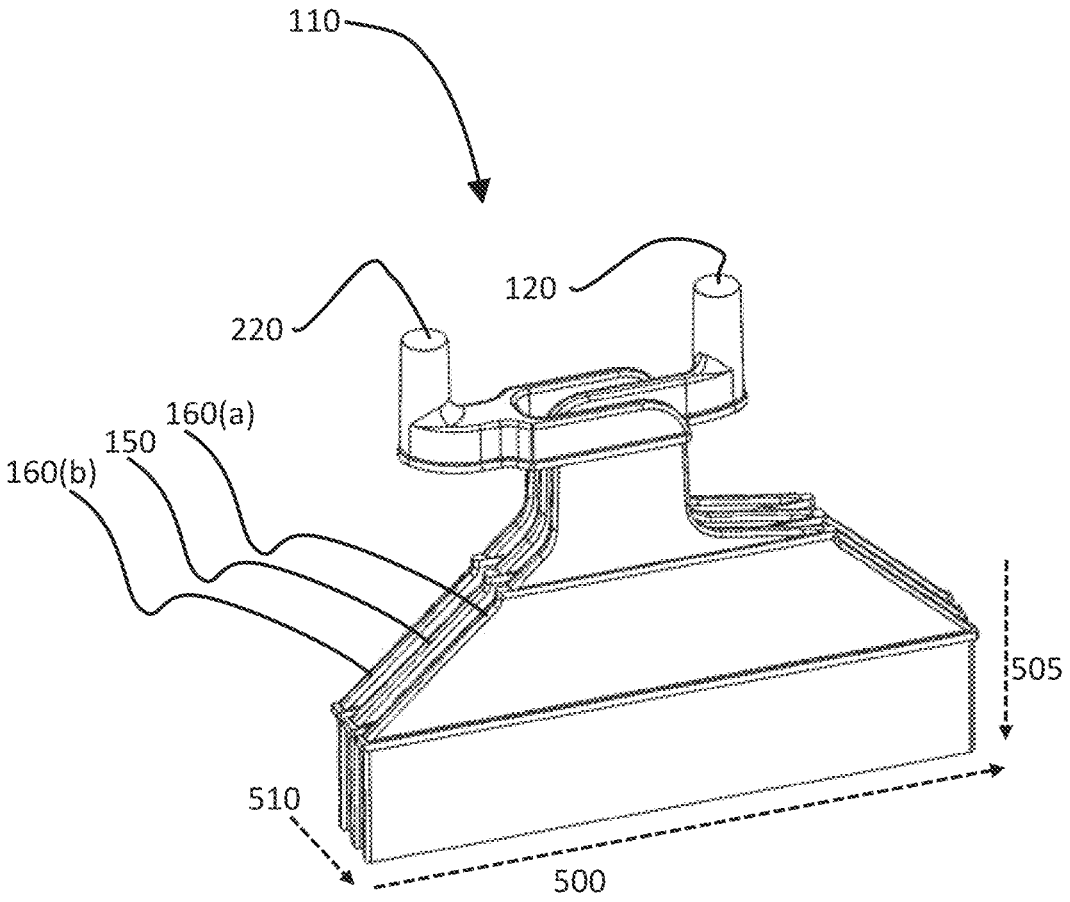
FIG. 7A is a cut-away three-dimensional view of the fluidic path in a through-flow enabled manifold component according to another test design.

Considering now FIG. 7, FIG. 7A is a cut-away three-dimensional view of the fluidic path in a through-flow enabled manifold component 110 according to a second test design. This may be referred to as a 'test' manifold component. FIG. 7B(a) is a cut-away three-dimensional view of the fluidic path in a manifold component 750 according to another embodiment that is through-flow enabled and has multiple horn-shaped portions. This may be referred to as a 'horned' manifold component. FIG. 7B(b) is a cross-sectional view through an inlet manifold chamber 55 in the manifold component 750 depicted in FIG. 7B(a), also including the slot 20(2). FIG. 7B(c) is a cross-sectional view through an outlet manifold chamber 60(*a*) in the manifold component 750 depicted in FIG. 7B(a), also including the slot 25(2)(*a*). FIG. 7C compares the calculated coefficient of reflection across the frequency range for a test manifold component as per FIG. 7A and a horned manifold component as per FIG. 7B. The calculations were performed in a similar manner to those described above with regards to FIG. 6C.

Figure 7B:
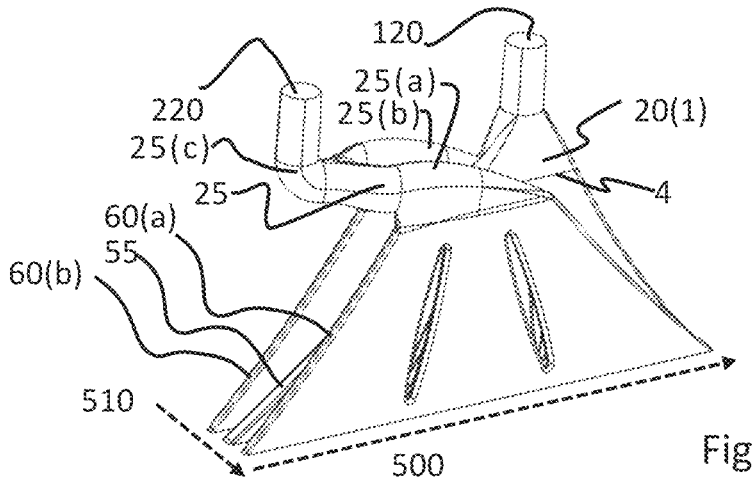
FIG. 7B(a) is a cut-away three-dimensional view of the fluidic path in a manifold component according to another embodiment that is through-flow enabled and has multiple horn-shaped portions.
Figure 7B:
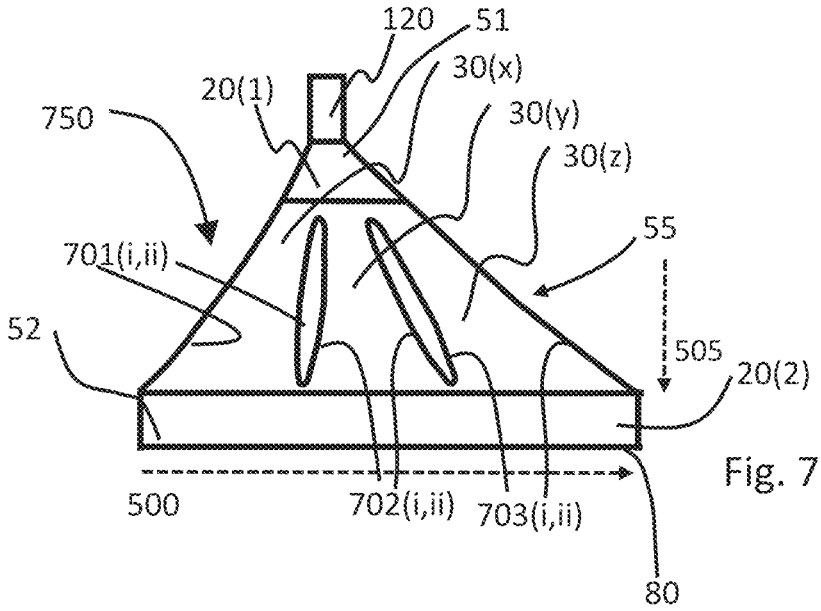
Figure 7B:
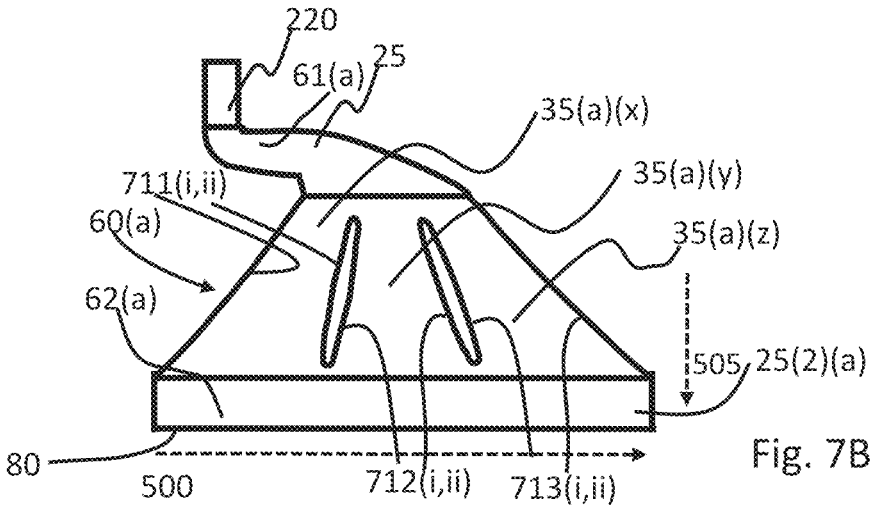
Figure 7B:
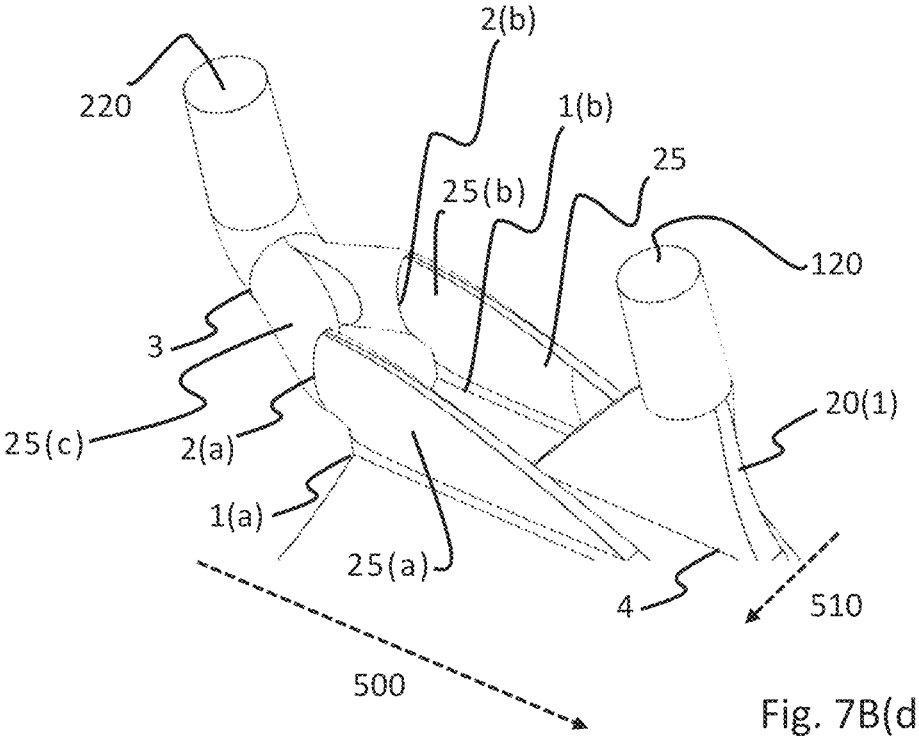

Turning now to FIG. 7B(a), the manifold component 750 illustrated therein is similar to the embodiment illustrated in FIG. 5 in that it has multiple horn-shaped portions and is through-flow enabled. It differs from the embodiment in FIG. 5 in that for ease of connection to a fluidic supply the outlet manifold chamber 60(*a*) is not an identical reflection of the inlet manifold chamber 55. The outlet manifold chambers 60(*a*) and 60(*b*) in the manifold component 750 are generally identical to each other. It can further be seen from FIG. 7B(a) that the outlet manifold chambers 60(*a,b*) are connected to a single port 220 and that the transitional portion 25 acts to merge the fluid exiting both outlet manifold chambers 60(*a,b*) before connecting to the port 220. The plurality of horn-shaped portions 30(*x,y,z*) and 35(*a,b*)(*x,y,z*) may have a cross-sectional area that increases in a hyperbolic fashion over at least a portion of the distance in the ejection direction 505.

The example embodiment shown in FIG. 7B(a) relates in general to a manifold component 750 for a droplet ejection head. The manifold component 750 comprises a mount 80 for receiving an actuator component 150 that provides one or more rows of fluid chambers, each chamber being provided with a respective at least one actuating element and a respective at least one nozzle, the at least one actuating element for each chamber being actuable to eject a droplet of fluid in an ejection direction 505 through the corresponding at least one nozzle, each row extending in a row direction 500. The manifold component 750 has manifold chambers 55, 60(*a*), 60(*b*) that extend from respective first ends 51, 61(*a*), 61(*b*) to respective second ends 52, 62(*a*), 62(*b*), and widens from said first ends 51, 61(*a*), 61(*b*) to said second ends 52, 62(*a*), 62(*b*). The second ends 52, 62(*a*), 62(*b*) of the manifold chambers 55, 60(*a*), 60(*b*) provide fluidic connection, in parallel, to at least a group of chambers within said one or more rows and are located adjacent to the mount 80. There are ports 120, 220, the former of which opens into the manifold chamber 55 at the first end 51 and the latter of which opens into the manifold chambers 60(*a*), 60(*b*) at the first ends 61(*a*), 61(*b*). The manifold chambers 55, 60(*a*), 60(*b*) comprise a plurality of horn-shaped passageways 30(*x,y,z*), 35(*a,b*)(*x,y,z*) the cross-sectional area of each of which decreases, at a decreasing rate, with distance from the second ends 52, 62(*a*), 62(*b*) of the manifold chambers 55, 60(*a*), 60(*b*). The horn-shaped passageways within each respective manifold chamber 55, 60(*a*), 60(*b*) are arranged side-by-side in an array which extends generally in the row direction 500. The ports 120, 220 are fluidically connected in parallel with their respective horn-shaped passageways 30(*x,y,z*) and 35(*a,b*)(*x,y,z*).

As can be seen from FIG. 7B(b) the horn-shaped passageways 30(*x,y,z*) comprise first (701-703)(*i*) and second (701-703)(*ii*) side surfaces, which are spaced apart in said row direction 500, said side surfaces 701-703(*i,ii*) being substantially concave. As for the manifold component 250 in FIG. 2, the manifold chamber 55 depicted in FIG. 7B(a) and 7B(b) includes a change in cross-sectional shape within the portion 20(1), in this implementation from circular to match the port 120, to elongate (in this instance rectangular) to match the actuator component 150 (not shown). The port 120 is also offset from the manifold chamber 55 in the depth direction 510 so the portion 20(1) also comprises shaping in the depth direction to connect the two.

Likewise as can be seen from FIG. 7B(c) the horn-shaped passageways 35(*a*)(*x,y,z*) comprise first (711-713)(*i*) and second (711-713)(*ii*) side surfaces, which are spaced apart in said row direction 500, said side surfaces 711-713(*i,ii*) being substantially concave.

Although not shown, it may be understood that manifold chamber 60(*b*) is similarly configured. One or more of the horn-shaped passageways 30(*x,y,z*), 35(*a,b*)(*x,y,z*) may have a hyperbolic profile. In some embodiments all of the horn-shaped passageways 30(*x,y,z*), 35(*a,b*)(*x,y,z*) may be shaped as a hyperbolic acoustic horn, whereby such horn-shaped passageways 30(*x,y,z*), 35(*a,b*)(*x,y,z*) may be described as hyperbolic horn-shaped portions 30(*x,y,z*) 35(*a,b*)(*x,y,z*).

The manifold chambers 60(*a*), 60(*b*) depicted in FIG. 7B(a) (and 60(*a*) depicted in FIG. 7B(c)) also include a change in cross-sectional shape from elongate to match the actuator component 150 (not shown), to circular to match the port 220 in the transitional portion 25. Also, as previously mentioned, the outlet manifold chambers 60(*a,b*) are connected to a single port 220 and that the transitional portion 25 acts to merge the fluid exiting both outlet manifold chambers 60(*a,b*) before connecting to the port 220.

FIG. 7B(d) is a detailed view of the fluidic path depicted in FIG. 7B(a) depicting the portions 20 and 25 in greater detail. It can be seen that the inlet port 120 is offset from the portion 20 such that the portion 20 further comprises a blended change in position in the depth direction 510 to connect the inlet port 120 to the rectangular cross-sectional area 4.

Considering FIG. 7B(d) further it can be seen that the transitional portion 25 comprises two arms 25(*a*) and 25(*b*), one per outlet manifold chamber 60(*a*)(*b*) which blend from rectangular cross-sectional areas 1(*a*) and 1(*b*) to oval cross-sectional areas 2(*a*) and 2(*b*) and then merge to form a single passage 25(*c*) which connects to outlet port 220 via a circular cross-sectional area 3. The transitional portion 25 has a blended cowl-like shape which may improve the fluid flow therein and which may also help to reduce acoustic crosstalk by assisting in transmitting acoustic waves out of the manifold chambers 60(*a*) and 60(*b*) and into the fluidic supply. It may be understood that this is merely one implementation and other combinations of cross-sectional shapes and areas and blended regions may be combined in any suitable manner to provide the transitional portion 25 with a blended cowl-like form, for example by sweeping a cross-sectional shape or shapes and/or a range of cross-sectional areas along suitable paths or trajectories. In some implementations the manifold chamber may have an elongate cross-sectional area. The transitional portion 25 may connect a number of cross-sectional areas, both at its ends where it is connectable to the port and the manifold chamber, and along the length of the transitional portion 25. In some implementations the cross-sectional shapes of the blended cowl-like form of the transitional portion 25 are chosen from a list comprising elongate, rectangular, oval, and circular. In some implementations such blended cowl-like forms may be formed from a 3D printed material. Such a transitional portion 25 may suitably be used in implementations with at least two, or more, manifold chambers, where at least two of said manifold chambers are connected to a single port, which may be an outlet port 220, wherein the transitional portion 25 connects the port 220 to the at least two manifold chambers 60(*a*)(*b*). In such an implementation the transitional portion 25 comprises at least one passage 25(*c*) and further comprises an arm 25(*a*)(*b*) per manifold chamber 60(*a*)(*b*). Further manifold chambers can be connected using a suitable number of additional arms, one per manifold chamber, where the arms may be merged together using any suitable number of connecting passages. It may be understood that such a transitional portion 25 may be used for two or more inlet manifold chambers or two or more outlet manifold chambers to connect to an inlet or outlet port respectively. Further such a transitional portion 25 may suitably be used in implementations where the two or more manifold chambers comprise one or more horn-shaped passageways, or in other implementations where the two or more manifold chambers do not comprise horn-shaped passageways.

Figure 7C:
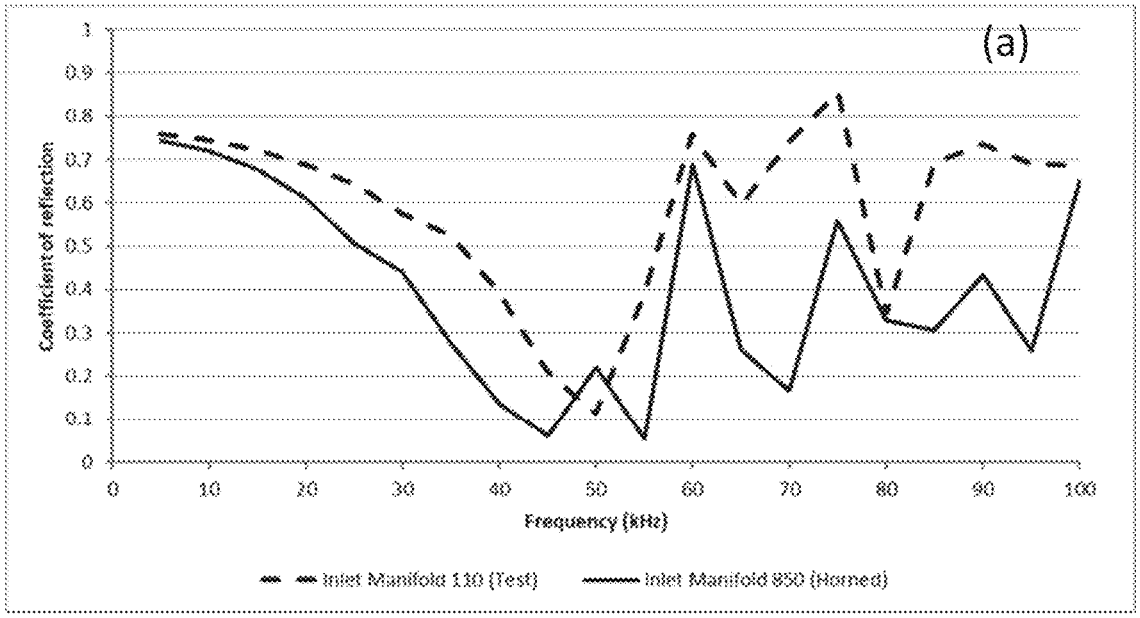
FIG. 7C compares the calculated coefficient of reflection across the frequency range for a manifold component as per FIG. 7A and a manifold component as per FIG. 7B.
Figure 7C:
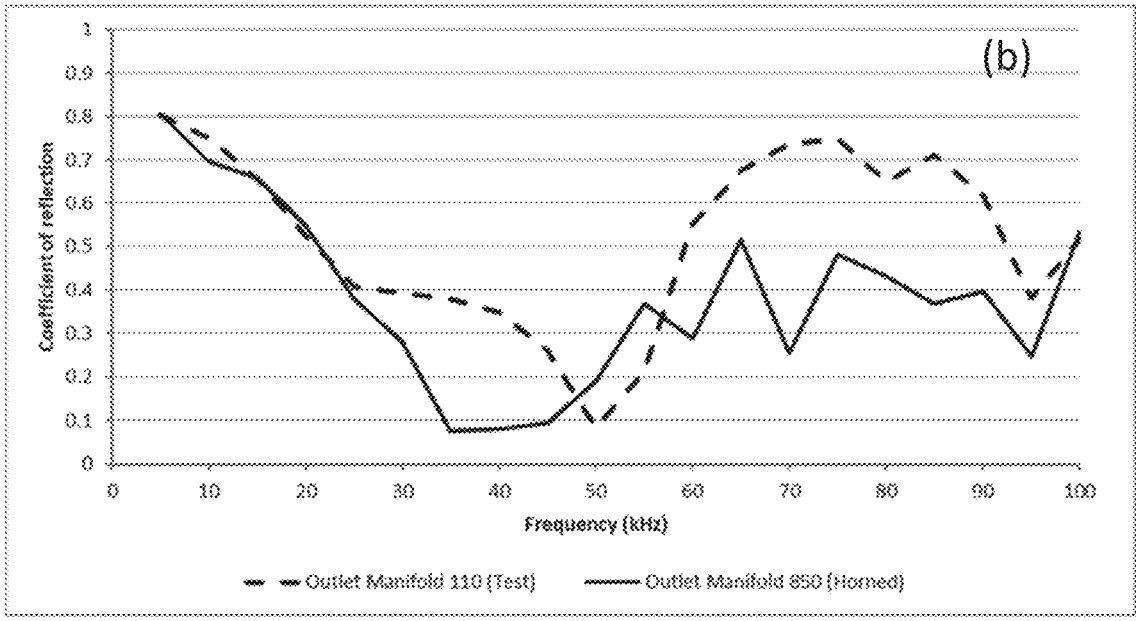

FIG. 7C compares the calculated coefficient of reflection across the frequency range of 0-100 kHz for a test manifold component as per FIG. 7A and a horned manifold component as per FIG. 7B. FIG. 7C(a) compares calculated coefficients of reflection across the frequency range for the inlet manifold chambers for the test (FIG. 7A) and horned (FIG. 7B) manifolds. FIG. 7C(b) compares calculated coefficients of reflection across the frequency range for an outlet manifold chamber in the test (FIG. 7A) and horned (FIG. 7B) manifolds. It can be seen that the coefficient of reflection is largely reduced for the horned manifold in both the inlet and outlet chambers as compared to the test manifold.

Figure 8:
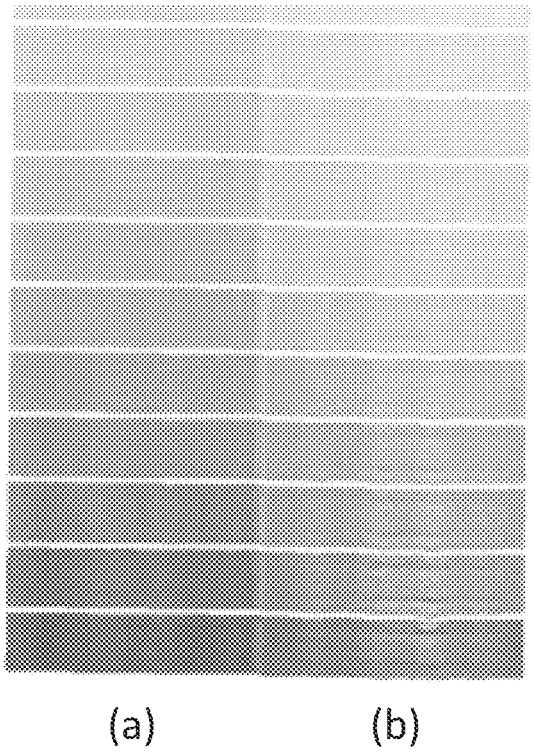
FIG. 8 is an extract from a print sample produced using drop-on-demand inkjet printheads.

Considering now FIG. 8, shown are respective print samples produced using a droplet ejection head comprising a test manifold component similar to FIG. 7A, and a horned manifold component similar to that in FIG. 7B. The print direction is along the vertical. The heads were operating in through-flow mode at a droplet frequency of 110 kHz. The samples were printed using magenta ink. It can be seen that, from top to bottom of the sample, the greyscale was increased successively per printed block. It may clearly be seen that the horned manifold component (FIG. 8(*a*)) produced an improvement in the quality of the print test sample as compared to the test manifold component (FIG. 8(*b*)). It is believed that the defects in the test manifold component print sample are due to acoustic crosstalk.

Figure 9A:
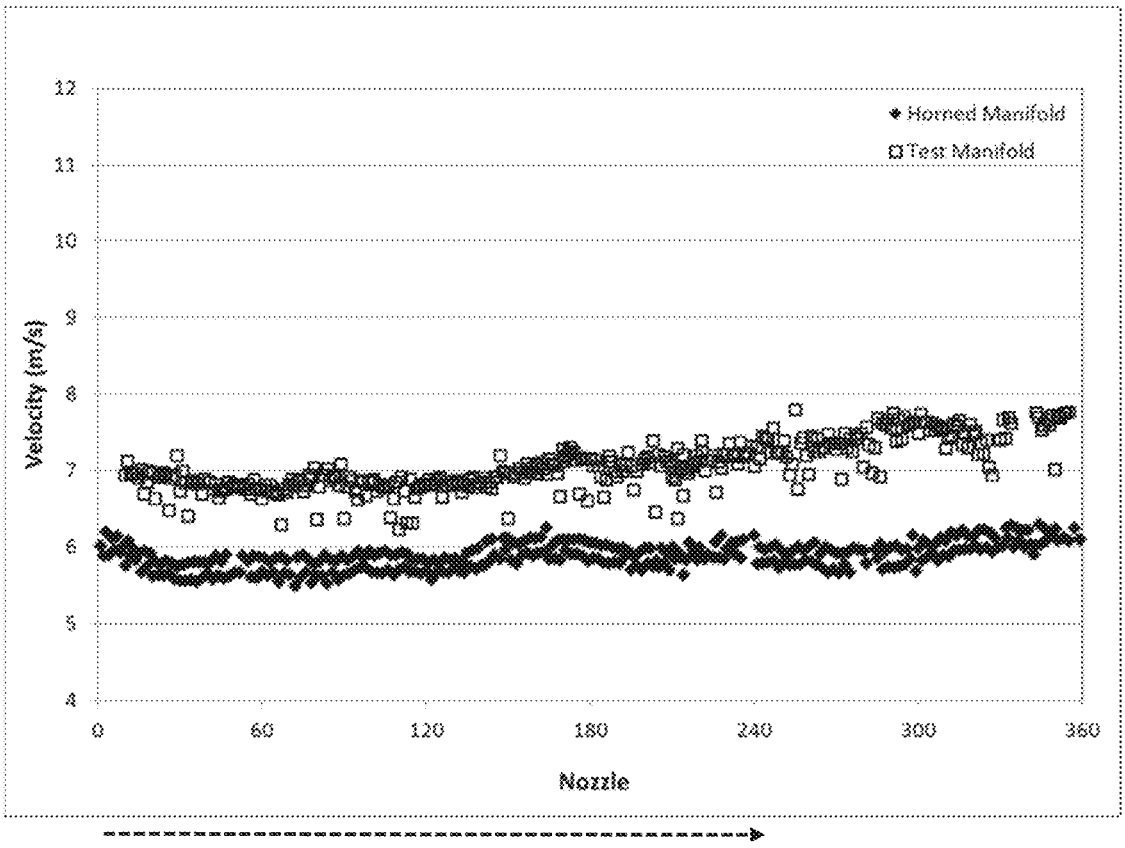
FIG. 9(A-C) are graphs comparing drop velocity data produced using a printhead comprising a test manifold component as per FIG. 7A and a printhead comprising a horn-shaped manifold component as per FIG. 7B.
Figure 9B:
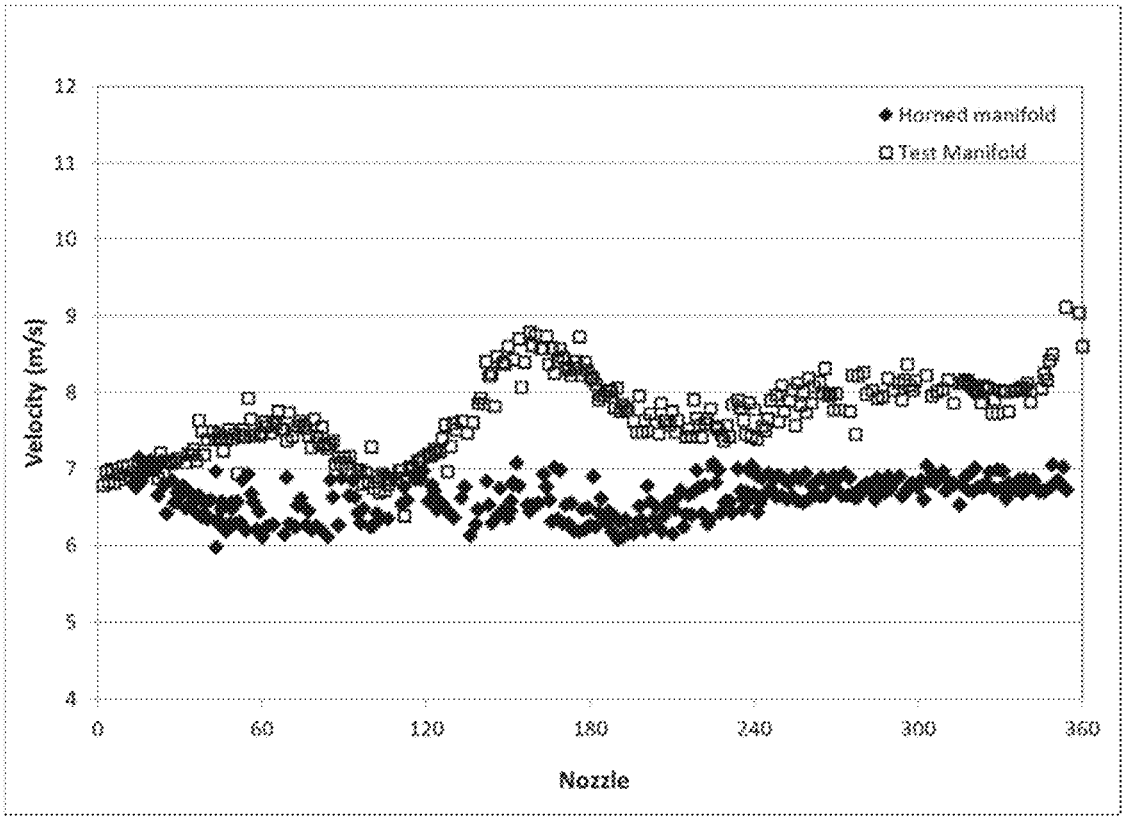
Figure 9C:
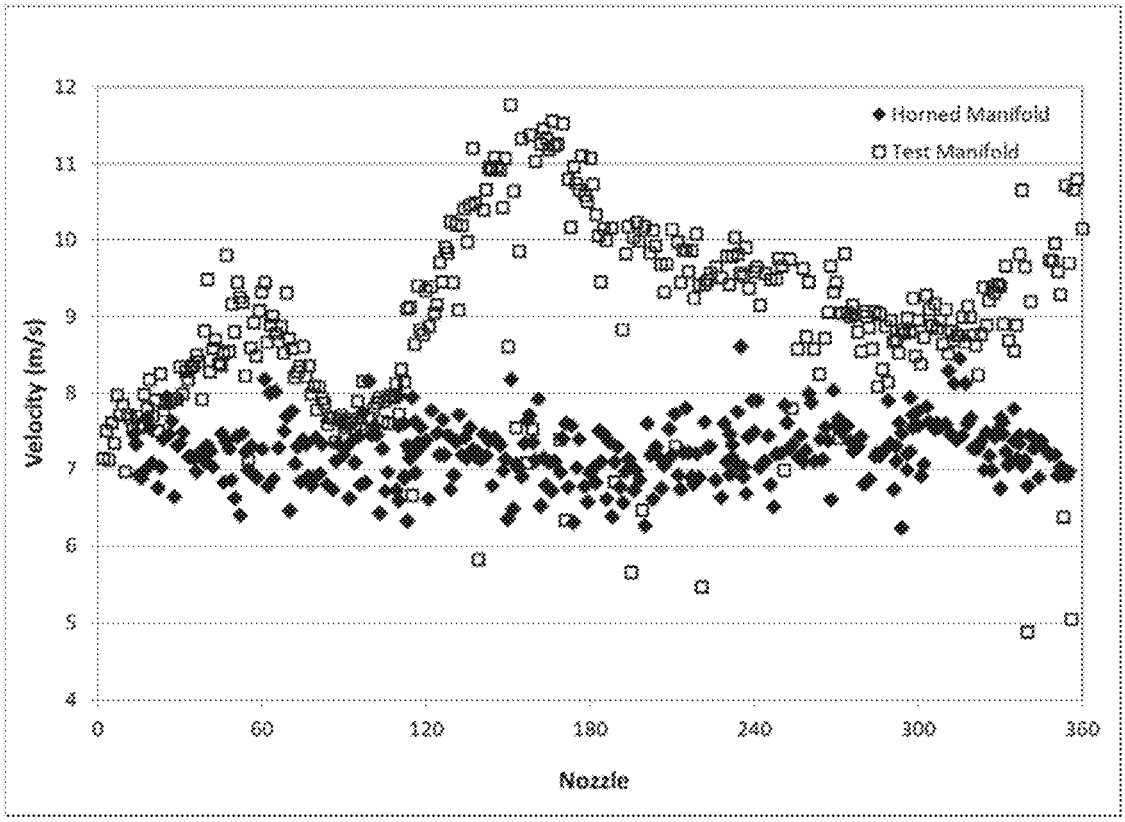

FIG. 9(A-C) are graphs comparing drop velocity data produced using a printhead comprising a test manifold component as per FIG. 7A and a printhead comprising a horned manifold component as per FIG. 7B. The data was collected using a commonly available brand of droplet measurement and analysis tool (a JetXpert™ Dropwatcher by ImageXpert®). The results compare the drop velocity data for droplets ejected from one row of 360 nozzles in the actuator component 150 at droplet ejection frequency (and the drive signal supplied to the actuators in the fluid chambers) of 5 kHz (FIG. 9A), 20 kHz (FIG. 9B) and 40 kHz (FIG. 9C). It can clearly be seen that at the frequencies measured, the drop velocity is more consistent in the row direction 500 for the horned manifold as opposed to the test manifold. At the higher frequencies considerable waviness and variability in the drop velocity profile in the row direction 500 can be seen for the test manifold as compared to the horned manifold.

Figure 10:
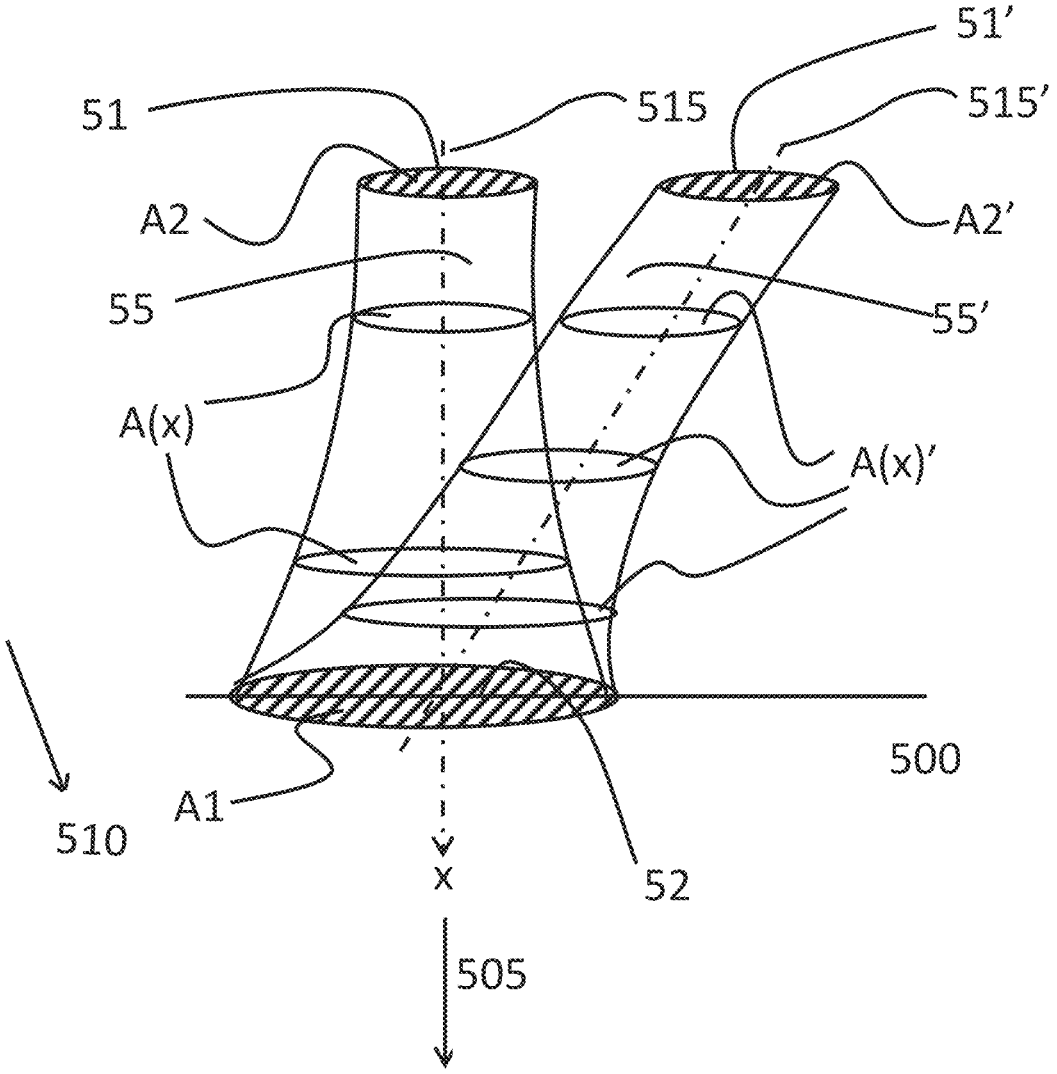
FIG. 10 is a schematic diagram depicting a method of designing a horn-shaped portion for a manifold component according to an embodiment.

FIG. 10 is a schematic diagram depicting a method of designing a horn-shaped portion for a manifold component according to an embodiment as described herein. As shown in FIG. 10, the method involves determining an initial shape for the manifold chamber 55, according to which the manifold chamber extends, along an initial, straight-line path 515, from a first end 51 to a second end 52, with there being a continuum of cross-sections A(x) perpendicular to the initial path 515, the areas of said cross-sections increasing from A2 to A1 with increasing distance from the first end 51, such that there is at least a portion of the manifold chamber for which the areas of the cross-sections A(x) increase in a hyperbolic fashion between the first end 51 and the second end 52. The next step involves deforming said initial path 515 to produce a modified path 515', with each cross-section A(x) being moved with a corresponding point on the initial path 515, thus providing a modified shape, manifold chamber 55' with cross sections A2', A(x)' which have the same cross-sectional areas as cross sections A2 and A(x). It may be seen that cross-section A1 at the second end 52 remains in its initial position. The deforming step depicted in FIG. 10 is such that the cross-sections A2', A(x)' and A1 remain substantially parallel, though it should be understood that this may not be essential in all embodiments. Furthermore the modified path 515' may be a straight-line path; and the deforming step may be such that the cross-sections A2', A(x)' and A1 remain substantially parallel to one another and angled with respect to said modified path 515'. In other embodiments it may be understood that other deforming steps may be implemented, for example using a non straight-line variant of path 515', or some other form of translation or rotation of the initial path 515.

It should be generally understood that for reasons of space constraint it may be desirable to have a manifold component as per any of the embodiments described herein where the extent of each manifold chamber 55, 60 in the ejection direction 505 is less than or equal to 2 times the extent in the row direction 500; and in some embodiments the extent of each manifold chamber in the row direction 500 is less than or equal to 2 times the extent in the ejection direction 505. In some embodiments it may be preferable that the extent of each manifold chamber in the row direction 500 is approximately equal to the extent in the ejection direction 505, as for those shown in FIGS. 3 and 4. It may be understood that where there are space constraints, using a multi-cellular horn with a plurality of horn-shaped portions as depicted in FIGS. 3 and 4 and elsewhere may enable a suitably compact design.

It may be understood that in some embodiments the mount 80 may for example comprise a flat receiving surface as in FIG. 1A to which the actuator component 150 may be attached by glue. Alternatively the mount 80 may have more complex arrangements of mounting surfaces and connecting elements and the use of fixing devices such as screws or pins or push fits or slide fits or glue to enable the actuator component 150 to be securely attached to any of the manifold components as described herein. The fluid chambers have been described as being in a row of fluid chambers; however, it should be understood that the row is not necessarily a straight line, and that fluid chambers can be staggered within the row.

In some embodiments the first portion 20 may comprise a hyperbolic acoustic horn as well as a change in cross-sectional shape to blend from the cross-sectional area of the port 120 to one that suits the actuator component 150. It may therefore be understood that an offset 58 may not be an essential feature in such embodiments. It should further be understood that the offset 58 is not necessarily a distance in a straight line in the ejection direction 500, it depends on the shape of the manifold chamber 55, the route that the central path 515 takes and where the portion that forms a hyperbolic acoustic horn occurs. It may be understood that the shape of the first portion 20 may therefore depend on the cross-sectional shape(s) of the port and the actuator component.

It may further be understood that manifold components may comprise a plurality of manifold chambers as described herein and arranged in any manner that is suitable for the application in question. The manifold components may comprise a plurality of inlet manifolds and/or a plurality of outlet manifolds. Some or all of the features described herein may be combined in any suitable manner to form a manifold component.

It may further be understood that where there are two or more manifold components of the same type (as depicted in FIGS. 5A and 7B) these may all have their own individual port (as depicted in FIG. 5A) or share a common port (as depicted in FIG. 7B). In the latter case, as depicted in FIG. 7B, the transitional portion 25 may divide the fluid path into a suitable number of arms to connect to the respective manifold chambers as well as to blend the cross-sectional shape and/or area of the fluid path from that of the common port to one that suits the actuator components 150. It should be understood that such an arrangement would work whether the manifold chambers are acting as inlet manifolds or outlet manifolds.

It should be understood that manifold components as described herein are suitable for inclusion in a wide variety of droplet ejection heads. In particular, manifold components as described herein are suitable for inclusion in droplet ejection heads having various applications.

In this regard, it should be appreciated that, depending on the particular application, a variety of fluids may be ejected by droplet ejection heads.

For instance, certain heads may be configured to eject ink, for example onto a sheet of paper or card, or other receiving media, such as ceramic tiles or shaped articles (e.g. cans, bottles etc.) Ink droplets may, for example, be deposited so as to form an image, as is the case in inkjet printing applications (where the droplet ejection head may be termed an inkjet printhead or, in particular examples, a drop-on-demand inkjet printhead).

Alternatively, droplet ejection heads may eject droplets of fluid that may be used to build structures, for example electrically active fluids may be deposited onto receiving media such as a circuit board so as to enable prototyping or manufacture of electrical devices. In examples, polymer containing fluids or molten polymer may be deposited in successive layers so as to produce a 3D object (as in 3D printing). In still other applications, droplet ejection heads might be adapted to deposit droplets of solution containing biological or chemical material onto a receiving medium such as a microassay. Droplet ejection heads suitable for such alternative fluids may be generally similar in construction to inkjet printheads—as may the manifold component therein—potentially with some adaptations made to handle the specific fluid in question.

Furthermore, it should be noted that droplet ejection heads may be arranged so as to eject droplets onto suitable receiving media, and may therefore be termed droplet deposition heads.

For instance, as mentioned above, the receiving media could be sheets of paper or card, ceramic tiles, shaped articles (e.g. cans, bottles etc.), circuit boards, or microassays.

Nonetheless, it is by no means essential that droplet ejection heads as described herein are arranged as droplet deposition heads, ejecting droplets onto receiving media. In some applications, it may be relatively unimportant where the ejected droplets land; for instance, in particular examples droplet ejection heads may be utilised to produce a mist of ejected droplets. Moreover, similar head constructions may, in some cases, be used whether or not the ejected droplets land on receiving media. Accordingly, the more general term "droplet ejection head" is (where appropriate) used in the above disclosure.

Manifold components as described in the above disclosure may be suitable for drop-on-demand inkjet printheads. In such heads, the pattern of droplets ejected varies in dependence upon the input data provided to the head.

A droplet ejection head may comprise a portion for a manifold component as described herein to connect the main portion of the manifold component to a port and an actuator component 150 fixed at the mount 80.

A droplet ejection head may comprise a manifold component as described in any of the above embodiments and an actuator component 150 fixed at the mount 80.

A droplet ejection head may comprise a manifold component as described in any of the above embodiments and an actuator component 150 fixed at the mount 80, wherein each group of chambers comprises at least 100 chambers.

The invention claimed is:

1. A manifold component for a droplet ejection head, the manifold component comprising:

a mount for receiving an actuator component that provides one or more rows of fluid chambers, each chamber being provided with a respective at least one actuating element and a respective at least one nozzle, the at least one actuating element for each chamber being actuable to eject a droplet of fluid in an ejection direction through the corresponding at least one nozzle, each row extending in a row direction;

a manifold chamber, which extends from a first end to a second end, and widens from said first end to said second end, the second end providing fluidic connection, in parallel, to at least a group of chambers within said one or more rows and being located adjacent said mount and at least one port, each port opening into the manifold chamber at the first end thereof;

wherein at least one portion between the first end and second end of the manifold chamber is shaped as a hyperbolic acoustic horn, wherein for each hyperbolic horn-shaped portion:

there is defined a depth direction which is perpendicular to said row direction and to said ejection direction;

there is defined a corresponding central path, which runs centrally through the hyperbolic horn-shaped portion in question, from the center of a first end to the center of a second end thereof;

there is defined, at each point on said central path, a corresponding width, which is measured in a direction that is normal to the central path at that point and that is perpendicular to said depth direction; and for the horn-shaped portion, said widths vary generally according to a hyperbolic function of distance from said first end of said horn-shaped portion along the central path.

2. The manifold component according to claim 1, wherein each hyperbolic horn-shaped portion extends at least the majority of the distance between the first end and second end of the corresponding manifold chamber.

3. The manifold component according to claim 2, wherein each hyperbolic horn-shaped portion extends between 0.6 and 0.9 times the distance between the first end and second end of the corresponding manifold chamber.

4. The manifold component according to claim 1, wherein said hyperbolic horn-shaped portion has a generally constant depth in the depth direction.

5. The manifold component according to claim 1, wherein said central path runs generally parallel to said ejection direction at the second end of the manifold chamber in question.

6. The manifold component according to claim 1, wherein the extent of said manifold chamber in said ejection direction is less than or equal to 2 times the extent in said row direction, at the second end of the manifold chamber; and wherein the extent of said manifold chamber in said row direction is less than or equal to 2 times the extent in said ejection direction, at the second end of the manifold chamber;

preferably wherein the extent of said manifold chamber in said row direction is approximately equal to the extent in said ejection direction, at the second end of the manifold chamber.

7. The manifold component according to claim 1, wherein the second end of said manifold chamber is defined by an opening which is elongate parallel to said row direction, and wherein at least two points on opposing ends of the elongate cross-section of said second end define the same angle to the wall of said manifold chamber.

8. The manifold component according to claim 1, wherein said manifold component further comprises a transitional portion that comprises a change in cross-sectional shape to blend from the cross-sectional area of the port to one that suits said actuator component.

9. The manifold component according to claim 8, wherein said transitional portion further comprises a hyperbolic acoustic horn.

10. The manifold component according to claim 1, wherein said manifold component comprises two or more manifold chambers, and wherein at least two of said two or more manifold chambers are connected to one port.

11. The manifold component according to claim 10, further comprising a transitional portion that comprises a change in cross-sectional shape to blend from the cross-sectional area of the port to one that suits said actuator component, wherein said transitional portion connects said port to said at least two manifold chambers, and wherein said transitional portion comprises at least one passage and further comprises an arm per manifold chamber of said at least two manifold chambers.

12. The manifold component according to claim 1, wherein some or all of said manifold component is manufactured using 3D printed material.

13. The manifold component according to claim 1, wherein said manifold chamber comprises a plurality of said hyperbolic horn-shaped portions, arranged side-by-side in an array.

14. The manifold component according to claim 13, wherein the manifold chamber comprises a plurality of said arrays of side-by-side hyperbolic horn-shaped portions, including an initial array of hyperbolic horn-shaped portions, which is proximate the first end of the manifold chamber, and a final array of hyperbolic horn-shaped portions, which is proximate the second end of the manifold chamber, said arrays being arranged consecutively from the first end to the second end of the manifold chamber, with the number of hyperbolic horn-shaped portions in each array increasing progressively from said initial array to said final array.

15. The manifold component according to claim 14, wherein the plurality of hyperbolic horn-shaped portions is arranged hierarchically, so that a hyperbolic horn-shaped portion in a given one of said arrays is fluidically connected to two or more hyperbolic horn-shaped portions in the consecutive array nearer the second end of the manifold chamber.

16. A droplet ejection head comprising the manifold component of claim 1, and said actuator component, fixed at said mount.

17. A method for designing a manifold component for a droplet ejection head, the manifold component comprising:

a mount for receiving an actuator component that provides one or more rows of fluid chambers, each chamber being provided with a respective at least one actuating element and a respective at least one nozzle, the at least one actuating element for each chamber being actuable to eject a droplet of fluid in an ejection direction through the corresponding at least one nozzle, each row extending in a row direction;

a manifold chamber, which extends from a first end to a second end, the second end providing fluidic connection, in parallel, to at least a group of chambers within said one or more rows and being located adjacent said mount; and at least one port, each port opening into the manifold chamber at the first end thereof;

wherein at least one portion between the first end and second end of the manifold chamber is shaped as a hyperbolic acoustic horn;

the method comprising the steps of:

determining an initial shape for the manifold chamber, according to which the manifold chamber extends, along an initial, straight-line path, from a first end to a second end, with there being a continuum of cross-sections perpendicular to the initial path, the areas of said cross-sections increasing with increasing distance from the first end, such that there is at least a portion of the manifold chamber for which the areas of the cross-sections increase in a hyperbolic fashion; and between the first end and the second end with the cross-sectional area measured perpendicular to said straight-line path increasing, such that there is at least a portion of the manifold chamber for which the cross-sectional area increases in a hyperbolic fashion, deforming said initial path to produce a modified path, with each cross-section being moved with a corresponding point on the initial path, thus providing a modified shape for said manifold chamber.

18. The method for designing a manifold component as per claim 17, wherein said deforming step is such that the cross-sections remain substantially parallel to one another.

19. The method for designing a manifold component as per claim 17, wherein said modified path is a straight-line path.

* * * * *